US006674978B1

(12) United States Patent
Suzuki et al.

(10) Patent No.: US 6,674,978 B1
(45) Date of Patent: Jan. 6, 2004

(54) INDUCTION HEATING TYPE IMAGE HEATING DEVICE

(75) Inventors: Masahiro Suzuki, Numazu (JP); Atsuyoshi Abe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/567,078

(22) Filed: May 8, 2000

(30) Foreign Application Priority Data

May 7, 1999 (JP) ..... 11-126949

(51) Int. Cl.[7] ..... G03G 15/20
(52) U.S. Cl. ..... 399/67; 399/328
(58) Field of Search ..... 399/67, 68, 69, 399/320, 328, 330, 333, 334, 336; 219/216

(56) References Cited

U.S. PATENT DOCUMENTS

| | | | | |
|---|---|---|---|---|
| 5,149,941 A | | 9/1992 | Hirabayashi et al. | 219/216 |
| 5,162,634 A | | 11/1992 | Kusaka et al. | 219/216 |
| 5,210,579 A | | 5/1993 | Setoriyama et al. | 355/285 |
| 5,262,834 A | | 11/1993 | Kusaka et al. | 355/285 |
| 5,300,997 A | | 4/1994 | Hirabayashi et al. | 355/285 |
| 5,343,280 A | | 8/1994 | Hirabayashi et al. | 355/285 |
| 5,525,775 A | | 6/1996 | Setoriyama et al. | 219/216 |
| 5,534,987 A | | 7/1996 | Ohtsuka et al. | 355/285 |
| 5,552,582 A | | 9/1996 | Abe et al. | 219/619 |
| 5,552,874 A | | 9/1996 | Ohtsuka et al. | 355/285 |
| 5,745,833 A | | 4/1998 | Abe et al. | 399/330 |
| 5,767,484 A | | 6/1998 | Hirabayashi et al. | 219/216 |
| 5,819,150 A | | 10/1998 | Hayasaki et al. | 399/330 |
| 5,832,354 A | * | 11/1998 | Kouno et al. | 399/330 |
| 5,852,462 A | * | 12/1998 | Lloyd et al. | 347/156 |
| 5,852,763 A | | 12/1998 | Okuda et al. | 399/329 |
| 5,881,349 A | | 3/1999 | Nanataki et al. | 399/328 |
| 5,940,655 A | | 8/1999 | Sano et al. | 399/69 |
| 5,956,543 A | * | 9/1999 | Aslam et al. | 399/45 |
| 5,966,577 A | | 10/1999 | Abe | 399/320 |
| 6,072,964 A | | 6/2000 | Abe et al. | 399/69 |
| 6,078,780 A | | 6/2000 | Abe et al. | 399/328 |
| 6,087,641 A | * | 7/2000 | Kinouchi et al. | 219/619 |
| 6,101,345 A | * | 8/2000 | Van Goethem et al. | 399/69 |

FOREIGN PATENT DOCUMENTS

| | | | |
|---|---|---|---|
| JP | 63-313182 | | 12/1988 |
| JP | 2-157878 | | 6/1990 |
| JP | 4-44075 | | 2/1992 |
| JP | 4-204980 | | 7/1992 |
| JP | 9-222823 | * | 8/1997 |

* cited by examiner

*Primary Examiner*—Quana M. Grainger
(74) *Attorney, Agent, or Firm*—Fitzpatrick, Cella, Harper & Scinto

(57) ABSTRACT

An image heating apparatus has a heating member and excitation coil for generating a magnetic field to induce eddy currents. A temperature detecting element detects a temperature of the heating member and electric power supply to the excitation coil is controlled to maintain a temperature detected by said temperature detecting element at a target temperature while a heating condition setting unit sets a feeding speed of the recording material and the target temperature.

6 Claims, 16 Drawing Sheets

INDUCTION HEATING TYPE IMAGE HEATING DEVICE

FIELD OF THE INVENTION AND RELATED ART

The present invention relates to an image heating device.

The image heating device includes a fixing device for heating and fixing an unfixed image on a recording material into a permanent fixed image thereon, an apparatus for temporarily fixing by heating an unfixed image, an apparatus for heating an image to improve a surface property such as gloss, or the like.

a) Heat roller type fixing device

Heretofore, in an image forming apparatus such as a copying machine, a facsimile machine, a laser beam printer or the like using an electrophotographic process, electrostatic recording process or the like, the use is made with a fixing device of a heat roller type which is one of a fixing devices an in which an unfixed toner image formed on a recording material (transfer material, photosensitive paper, electrostatic recording paper, print sheet OHP (OHT) film or the like) is heated and fixed thereon into a permanent fixed image.

FIG. 14 is a schematic cross-sectional view of an example of a heat roller type fixing device.

The fixing device comprises a pair of pressing rollers 201, 202, one of or both of which contain heat sources 201*a*, 202*a* such as halogen lamp or the like. The rollers constitute a nip N therebetween, and the recording material P is nipped and fed by the nip while being subjected to heat and pressure, so that unfixed toner image t is fixed on the recording material P.

The fixing roller 201 and the pressing roller 202 comprise hollow core shafts 201*b*, 202*b* of aluminum or the like, elastic layers 201*c*, 202*c* of silicone rubber on the outer surfaces of the core shafts, and parting layers 201*d*, 202*d* of fluorine resin material or the like on the outer surfaces, respectively.

Generally, the roller contactable to the unfixed toner image t is "fixing roller", and the roller not contactable to the unfixed toner image t is "pressing roller". The temperatures of the fixing and pressing rollers 201, 202 are detected by temperature detecting means 26 such as thermister means contacted to the roller surface, and the detected temperature is fed back to an ON/OFF control circuit (unshown) for activating and deactivating heat sources 201*a*, 202*a* so as to maintain a predetermined temperature.

The heat quantity applied to the recording material P per unit time is determined mainly on the basis of the width of the nip, the roller temperature and the recording material feeding speed. Among these factors, the roller temperature and the recording material feeding speed can be relatively easily exchanged in accordance with a desired fixing process and the recording material so as to supply proper heat quantity.

For example, the glossiness (gloss) of the fixed image is significantly influenced by the recording material feeding speed and the roller control temperature of the fixing device. The gloss tends to be higher if the roller control temperature is higher and if the recording material feeding speed is slower, within a certain range. In other words, the gloss rises with increase of the heat quantity.

By adjusting the parameters, the gloss of the image can be controlled. For example, in an image forming apparatus producing low gloss images, high gloss images can be provided by controlling the fixing condition.

As for the recording material used with the image forming apparatus, there are OHP (overhead projector) film, gloss film or the like in addition to the sheet of paper. The former is a transparent resin film through which light from a projector is transmitted, and the latter is a white resin film having a glossiness. They are made of synthetic resin material film such as PET having a thickness of 4–5 microns so that thermal capacity is very large as compared with that of usually paper. Therefore, a larger amount of heat supply is required to properly fix the unfixed toner image. Furthermore, the OHP film requires good permeability, and gloss film requires high glossiness. In order to accomplish this, it is desirable that toner is sufficiently fused and deformed to smooth the surface of the toner image. Therefore, it is necessary to increase the amount of the heat supply by decreasing the recording material feeding speed or by rising the roller control temperature.

Thus, in order to control the glossiness of the image or to improve the permeability or the glossiness of the image on the film, the recording material feeding speed and/or the roller control temperature is instantaneously switched to provide an optimum amount of the heat supply. If the roller control temperature is constant irrespective of the recording material feeding speed, the amount of the heat tends to be insufficient or too much at the time of changing the recording material feeding speed with the result of fixing defect or unintended image quality. Therefore, it is desirable that roller control temperature is changed in accordance with the recording material feeding speed.

However, in the case of the heat roller type fixing device, the surface temperature of the fixing roller 201 (heating portion material) does not become the set control temperature instantaneously after the roller control temperature is switched. Such a poor thermal responsivity results mainly from the following two factors.

The first is that heat source 201*a* is away from the surface of the roller in the case of the fixing roller 201. For example, the heat from the heat source 201*a* in the fixing roller 201 is transferred to the surface of the roller from the heat source 201*a* (halogen lamp or the like) via air layer, core shaft 201*b* (A1 or the like), elastic layer 201*c* the magnetic field for heating an image on a recording material; a temperature detecting element for detecting a temperature of said heating portion material; control means for controlling said magnetic field generating means to maintain a temperature detected by said temperature detecting means at a target temperature; heating condition setting means for setting a feeding speed of the target temperature.

The second cause is that thermal capacity of the entire fixing roller 101 is relatively large. This leads to larger amount of heat quantity required to rise the temperature of the roller so that in the thermal responsivity is worsened. This is also a cause of the fact that roller temperature does not easily lower.

For these reasons, the temperature of the roller surface does not linearly follow the switching of the control temperature.

In such a fixing device, when the recording material feeding speed is switched from a normal speed to a slower speed, excessive supply of the heat results, so that problem of hot offset or OHPpermeability decrease arises. Additionally, there arises a problem that high gloss image is not provided even under a high gloss fixing condition.

Moreover, the next printing operation is required to be interrupted until the surface temperature of the fixing roller 201 reaches the control temperature to avoid the image defects described above.

b) Fixing device of a film heating type using a ceramic heater

The inventors have investigated the possibility of improving the thermal responsivity of a fixing device of a film heating type using a ceramic heater.

Such a fixing device has been proposed in Japanese Laid-open Patent Application No. SHO 63-313182, Japanese Laid-open Patent Application No. HEI 2-157878, Japanese Laid-open Patent Application No. HEI 4-44075, Japanese Laid-open Patent Application No. HEI 4-204980, for example.

FIG. 15 is a schematic view of an example of such a fixing device.

The rotatable member 10 constituting the nip N is a cylindrical fixing film. From the standpoint of reducing the thermal capacity an improve the quick start feature, the fixing film 10 preferably has a film thickness of not more than 100 μm, preferably not more than 50 μm and not less than 20 μm and is a heat resistive film of a monolayer of PTFE, PFA, FEP resin material or a complex layer film comprising a PI, PAI, PSEK, PES, PPS resin material, a coating layer of PTFE, PFA, FEP with an electroconductive primer layer therebetween.

Designated by a reference numeral 16 is a film guide of arcuate trough type.

Designated by a reference numeral 5 is a ceramic heater extending in a longitudinal direction of the film guide nip. The ceramic heater 5 comprises a substrate 5*a* of alumina or the like, a heat generation layer 5*b* of Ag/Pd or the like which is painted by screen printing or the like into approx 10 μm thick and 1–5 mm width on the substrate 5*a,* and a protection layer 5*c* thereon of glass, fluorine resin material or the like.

Designated by a reference numeral 30 is a pressing roller (pressing rotatable member).

Designated by 26 is a temperature detecting element using a thermister end is disposed on a back side of the ceramic heater 5.

The temperature control is effected by phase control, wave number control or the like of the ACvoltage supplied to the ceramic heater 5 by a TRIAC 6 on the basis of information from the temperature detecting element 26 so that electric power supplied to the ceramic heater 5 is controlled.

A fixing film 10 is sandwiched between the ceramic heater 5 and the pressing roller 30 (pressing member) to form a nip N, and a recording material P carrying an unfixed toner image t is passed through the nip between the fixing film 10 and pressing roller 30, wherein the recording material P is moved together with the fixing film 10, by which the heat from the ceramic heater 5 is applied to an image through the fixing, so that image is fixed on a recording material P by the pressure of the nip N and the heat.

Therefore, the fixing device uses a ceramic heater 5 and fixing film 10 having low thermal capacities to constitute an on-demand type apparatus. Only during the execution of the image forming operation, the electric energy is supplied from the heat source to the ceramic heater 5 to heat it to a predetermined fixing temperature. Therefore, the waiting period until the image formation executable state is reached from the actuation of the power source is short (quick start feature), and the electric energy consumption being the stand-by state is significantly reduced (electric power saving), and therefore, the thermal responsivity is remarkably better than the heat roller type.

The fixing device has a very good thermal responsivity as compared with the heat roller type because the thermal capacity of the film 10 of the fixing member is very small, and because the ceramic heater 5 (heat source) is close to the inner surface of the fixing film 10. Thus, it is possible to cause the surface temperature of the heating portion material (fixing film 10) to follow linearly the switching of the control temperature in response to switching of the recording material feeding speed.

However, such a film heating type fixing device using a ceramic heater having a very good thermal responsivity as compared with the best roller type still involves the following problems.

In the fixing device, the fixing film 10 cannot accommodate the height of the toner image t due to the difference of the quantity of the toner and the unsmoothness of the surface of the recording material itself in some cases, with the result of unable glossiness of the fixed image.

In order to solve this problem, the surface of the fixing film 10 is made soft by a providing a 300 μm thick of an elastic layer of silicone rubber or the like with the fixing film 10. However, when such a fixing device is used as a fixing device for a full color image forming apparatus, the total thermal capacity of the fixing film 10 and the total thermal resistance increase with the result of lowered thermal responsivity of the fixing device.

In a film heating type device using a ceramic heater 5, the pressing roller 30 is urged toward the ceramic heater 5 which is a heat source, through the fixing film 10 therebetween. The heat generation of the ceramic heater 5 results in the thermal-expansion of the heater per se. Therefore, the stress due to the thermal-expansion in the ceramic heater 5 is larger, and therefore, the heater is more easily broken, if the pressure at the nip N is larger.

For this reason, the pressure is not so high in the fixing device of this type. For example, the pressure in the heat roller type can be as high as 40 kgf, whereas in the fixing device of the film heating type using the ceramic heater is approx 10–15 kgf.

Therefore, even if the ORFfilm is fed at a speed lower than the normal speed, the surface of the fixing toner image is not sufficiently smooth due to insufficiency in the pressure with the result of lower permeability of the full-color image on the OHFfilm.

For the same reason, it is difficult to increase the glossiness of the image.

A fixing device using an induction heating technique has been proposed, but no fixing device of the induction heating type capable of selecting optimum fixing condition or a fixing device of the induction heating type capable of selecting the glossiness of the image as desired.

SUMMARY OF THE INVENTION

Accordingly, it is a principal object of the present invention to provide an image heating device which is capable of quickly setting an optimum fixing condition in accordance with the recording materials.

It is another object of the present invention to provide an image heating device which is capable of setting the glossiness of the image as desired.

According to an aspect of the present invention, there is provided an image heating apparatus, comprising magnetic field generating means for generating a magnetic field; a heating portion material for generating heat using eddy currents produced by themagnetic field and for heating an image on a recording material; a temperature detecting element for detecting a temperature of said heating portion material; control means for controlling said magnetic field generating means to maintain a temperature detected by said temperature detecting means at a target temperature; heating condition setting means for setting a feeding speed of the target temperature.

According to another aspect of the present invention, there is provided an image heating apparatus, comprising: a magnetic field generating means for generating a magnetic field; a heating portion material for generating heat using eddy currents produced by the magnetic field and for heating an image on a recording material; a temperature detecting element for detecting a temperature of said heating portion material; control means for controlling said magnetic field generating means to maintain a temperature detected by said temperature detected by said temperature detecting means at a target temperature; wherein the target temperature is variable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

<Embodiment 1>

Figure 1:
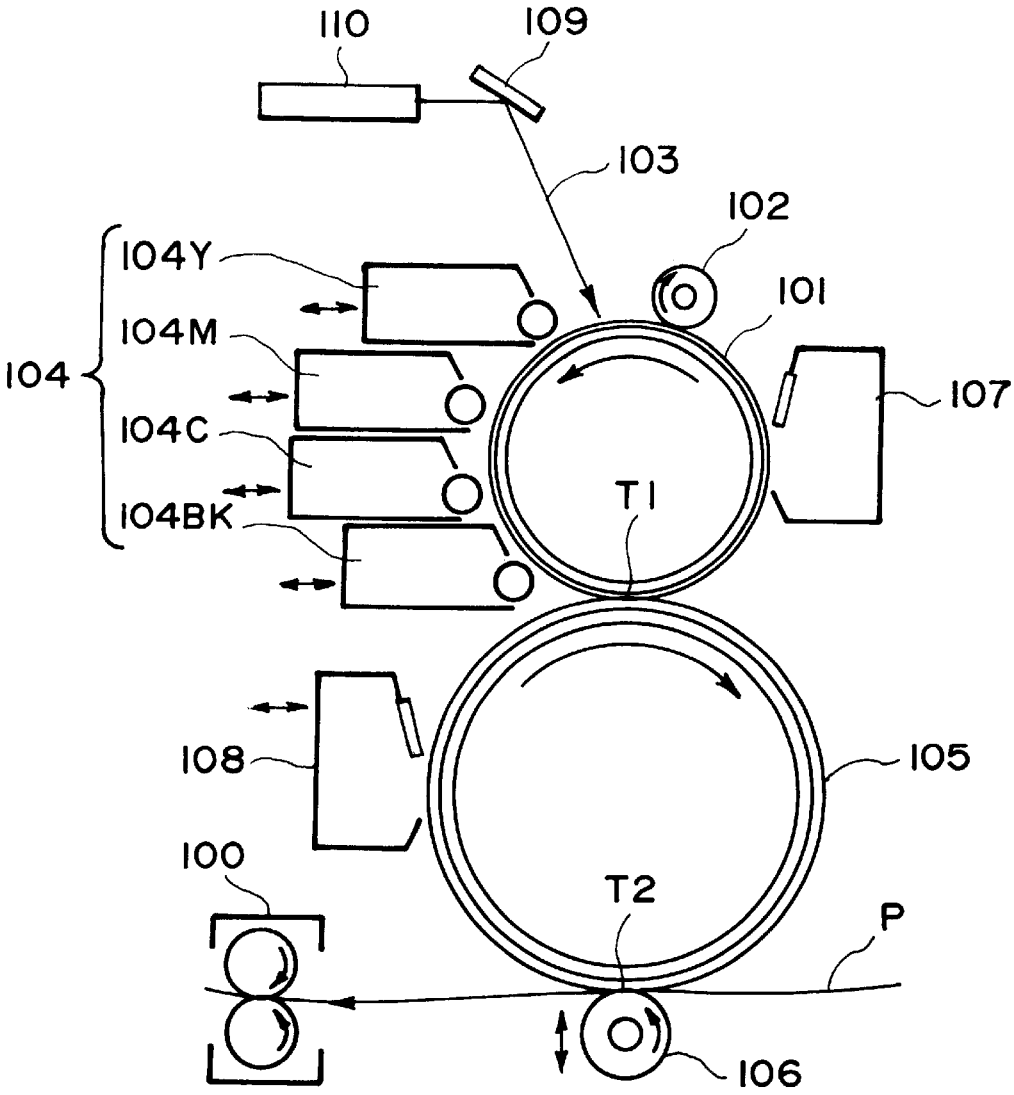
FIG. 1 is a schematic sectional view of the image forming apparatus in the first embodiment of the present invention, and shows the general structure of the apparatus.

FIG. 1 is a schematic sectional view of an example of an image forming apparatus. The image forming apparatus in this embodiment is a closer laser printer.

A referential code 101 designates a photosensitive drum (image bearing member) based on organic photosensitive material or amorphous silicon. The photosensitive drum 101 is rotationally driven in the counterclockwise direction at a predetermined process speed (peripheral velocity).

As the photosensitive drum 101 is rotated, it is uniformly charged to predetermined polarity and potential level by a charging apparatus 2 such as a charge roller.

Next, the charged surface of the photosensitive drum 101 is exposed to a scanning laser beam 103 projected from a laser optics box 110 (laser scanner). The laser optics box 110 outputs the laser beam 103 modulated (turned on or off) with sequential digital signals representing the image data from an unillustrated image signal generating apparatus such as an image reading apparatus. As a result, an electrostatic latent image in accordance with the image data is formed on the peripheral surface of the photosensitive drum 101 by the scanning laser beam. A referential code 109 designates a mirror for deflecting the laser beam outputted from the laser optics box 110, toward exposure points on the photosensitive drum 101.

In the case of full-color image formation, first, a latent image correspondent to the first of the color components of an intended full-color image, for example, yellow component, is formed through the aforementioned scanning exposure process, and this latent image is developed into a toner image of yellow color through the operation of an yellow developing device 104Y, that is, one of the four color developing devices of the developing apparatus 104. Then, the yellow toner image is transferred onto the peripheral surface of an intermediary transfer drum 105, in the primary transfer station T1, that is, region in which the peripheral surfaces of the photosensitive drum 101 and intermediary transfer drum 105 make contact with each other (or the distance between them is smallest). After the transfer of the toner image onto the peripheral surface of the intermediary transfer drum 105, the peripheral surface of the photosensitive drum 101 is cleaned by removing the debris adhering to the peripheral surface of the photosensitive drum 101, for example, the transfer residual toner, that is, the toner which remained on the peripheral surface of the photosensitive drum 101.

The above described cycle constituted of the charging process, scanning exposure process, development process, primary transfer process, and cleaning process is sequentially repeated for the second of the color components of the intended full-color image (for example, magenta color, magenta developing device 104M is activated), the third of the color components (for example, cyan component, cyan developing device 104C is activated), and the fourth of the color components of the intended full-color image (for example, black component; black developing device 104Bk is activated). As a result, the yellow toner image, magenta toner image, cyan toner image, and black toner image, are sequentially transferred in layers onto the peripheral surface of the intermediary transfer drum 105, realizing a multi-color toner image reflecting the intended full-color image.

The intermediary transfer drum 105 comprises a metallic drum, an elastic layer coated on the peripheral surface of the metallic drum, and a surface layer coated on the elastic layer. In terms of electrical resistance, the elastic layer and surface layer are in the medium and high ranges, respectively. The intermediary transfer drum 105 is disposed so that the peripheral surfaces of the intermediary transfer drum 105 and photosensitive drum 101 made contact with each other, or hold a microscopic distance between them. It is rotationally driven in the clockwise direction indicated by an arrow mark at approximately the same peripheral velocity as the photosensitive drum 101, while bias (voltage) is applied to the metallic drum of the intermediary transfer drum 105, so that the toner images on the peripheral surface of the photosensitive drum 101 are transferred onto the peripheral surface of the intermediary transfer drum 105 by the difference in electrical potential level between the photosensitive drum 101 and intermediary transfer drum 105.

The multi-color toner image formed on the peripheral surface of the aforementioned intermediary transfer drum 105 is transferred, in a secondary transfer station T2, that is, the contact nip between the intermediary transfer drum 105 and a transfer roller 106, onto the surface of the recording medium P which is sent into the secondary transfer station T2, from an unillustrated sheet feeding portion, with a predetermined timing. The transfer roller 106 supplies the recording medium P with electrical charge opposite in polarity to the toner, from the back side of the recording medium P, so that the synthetic color images are continually transferred all together from the peripheral surface of the intermediary transfer drum 105 onto the recording medium P, starting from their leading ends.

After passing through the secondary transfer station T2, the recording medium P is separated from the peripheral surface of the intermediary transfer drum 105, and introduced into a fixing apparatus 100 (image bearing apparatus), in which the unfixed toner images are thermally fixed. Thereafter, the recording medium P is discharged into an unillustrated external delivery tray.

After the transfer of the color toner images onto the recording medium P, the intermediary transfer drum 105 is cleaned by a cleaner 108; the debris such as the transfer residual toner or paper dust adhering to the intermediary transfer drum 105 is removed by the cleaner 108. The cleaner 108 remains separated from the intermediary transfer drum 105 in the normal state, and is placed and kept in contact with the intermediary transfer drum 105 during the secondary transfer process in which the color toner images are transferred from the intermediary transfer drum 105 onto the recording medium P.

Also, the transfer roller 106 is kept separated from the intermediary transfer drum 105 in the normal state, and is placed and kept in contact with the recording medium P in a manner to keep the recording medium pressed upon the intermediary transfer drum 105, during the secondary transfer process in which the color toner images are transferred from the intermediary transfer drum 105 onto the recording medium P.

The image forming apparatus in this embodiment is capable of operating in a monochromatic print mode as well as a color print mode. It also is capable of operating in a two-side print mode.

In a two-side print mode, after receiving an image on one of the two recording surfaces, and being discharged from the fixing apparatus 100, the recording medium P is flipped over by an unillustrated recirculating conveyer mechanism, to be again sent into the secondary transfer station T2, in which a toner image or plural toner images are transferred onto the other surface of the recording medium P. Thereafter, the recording medium P is introduced again into the fixing apparatus 100, in which the toner image, or toner images, are fixed to the second surface. Thereafter, the recording medium P, which, at this point, is holding images on both recording surfaces, is outputted from the image forming apparatus.

The image forming apparatus in this embodiment is capable of conveying the recording medium P at a total of five different velocities: 50 mm/sec, 40 mm/sec, 30 mm/sec, and 20 mm/sec, in addition to the normal velocity of 100 mm/sec. Thus, a desired conveyance velocity may be manually selected using the selecting means provided in an unillustrated control section, or a proper conveyance velocity is automatically selected in accordance with the specification of the recording medium, or the information regarding the recording medium is detected by a recording medium type detecting means.

In this embodiment, the intermediary transfer member 105 is employed. Thus, up to the end of the primary transfer process in which the toner images on the photosensitive drum 101 are transferred onto the intermediary transfer drum 105, each element (developing apparatus and transferring apparatus) is rotationally driven at a peripheral velocity equivalent to the conveyance velocity of 100 mm/sec. Thereafter, that is, after the feeding of the recording medium P, the conveyance velocity is switched to the selected conveyance velocity for the rest of the current image formation cycle, that is, the secondary transfer process and fixing process.

(2) Fixing Apparatus 100

A) General Structure of Apparatus

Figure 2:
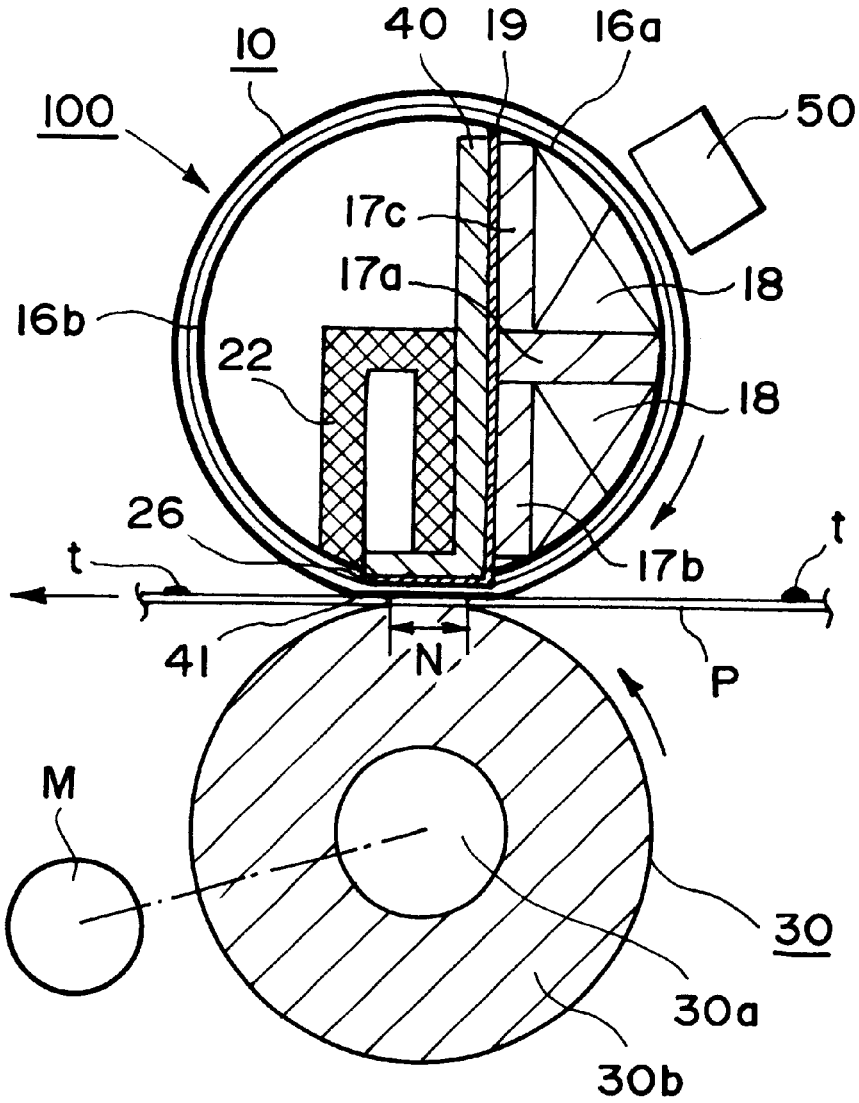
FIG. 2 is a schematic sectional view of the essential portion of a fixing apparatus, at a plane perpendicular to the longitudinal axis of the apparatus.
Figure 3:
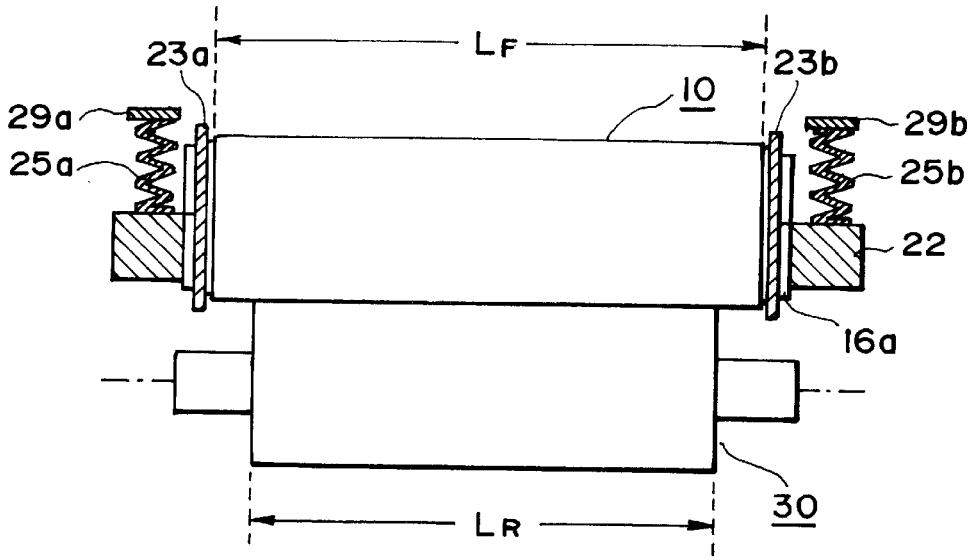
FIG. 3 is a schematic front view of the portion illustrated in FIG. 2.
Figure 4:
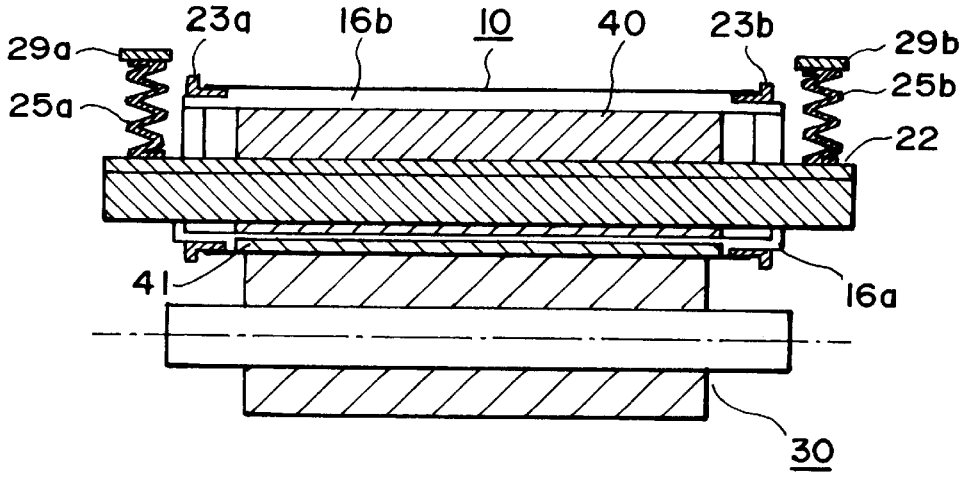
FIG. 4 is a schematic sectional view of the portion illustrated in FIG. 2, at a vertical plane.

The fixing apparatus 100 as an image heating apparatus in this embodiment is an electromagnetic induction type heating apparatus. FIG. 2 is a schematic sectional view of the essential portion of the fixing apparatus 100 in this embodiment, at a plane perpendicular to the longitudinal axis of the apparatus, and FIG. 3 is a schematic front view of the essential portion of the fixing apparatus 100 in this embodiment. FIG. 4 is a schematic sectional view of the same essential portion as the one in FIG. 2, at the horizontal plane which intersects with the longitudinal axes of the rollers.

The fixing apparatus 100 in this embodiment is an electromagnetic induction type heating apparatus. It employs a cylindrical film, in which heat is electromagnetically induced, and which is driven by a pressure roller.

A magnetic field generating means comprises a plurality of magnetic cores 17*a*, 17*b* and 17*c* and an exciting coil 18.

The magnetic cores 17*a*, 17*b* and 17*c* should be highly permeable members, and therefore, material such as ferrite or Permalloy, which is used as the material for the core of a transformer, is desirable as the material for these cores 17*a*, 17*b* and 17*c*. A preferable choice is such ferrite that is small in loss even in a situation in which the frequency is no less than 100 kHz.

Figure 5:
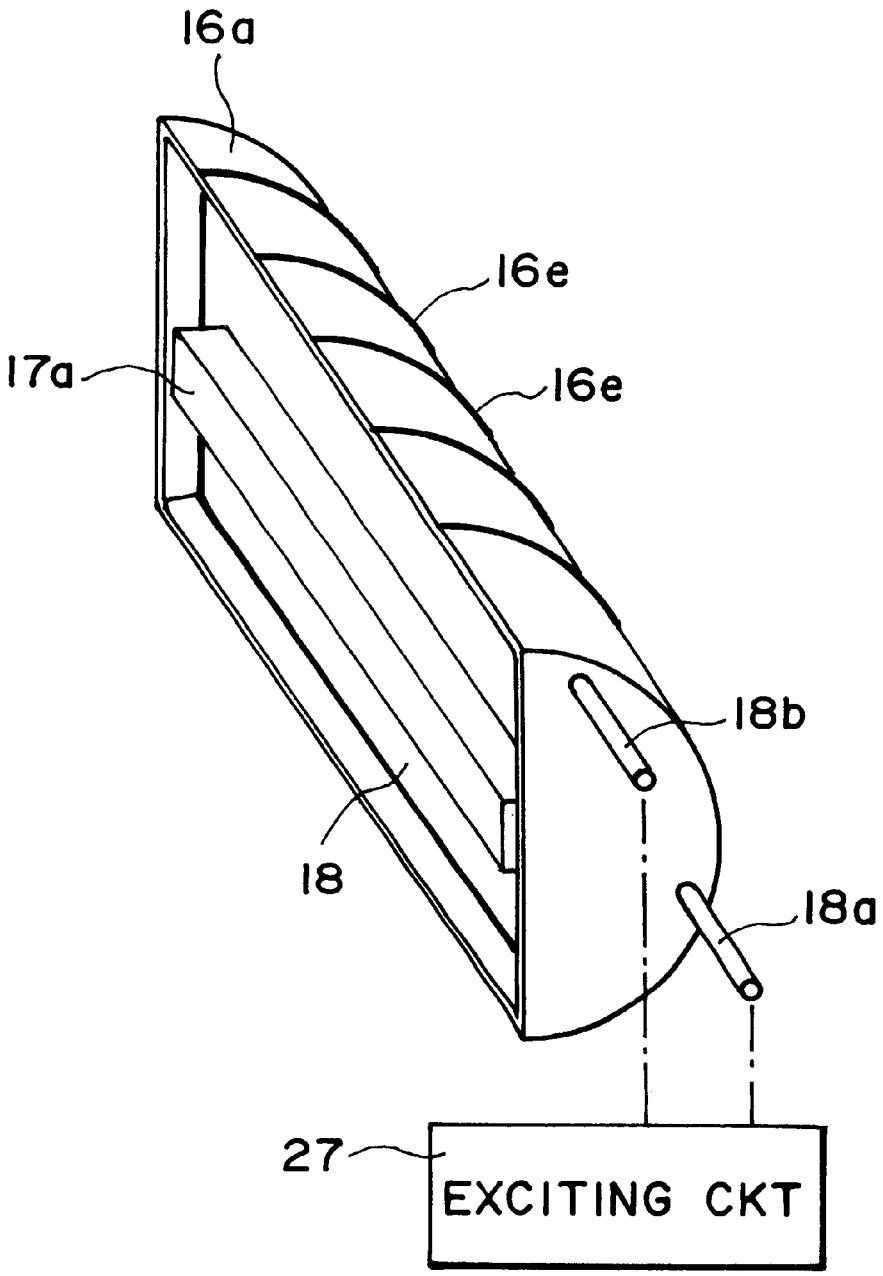
FIG. 5 is a schematic perspective view of the film guide portion on the right-hand side, in which an exciting coil and a magnetic core are disposed.

To the exciting coil, an exciting circuit 27 is connected at power supply portions 18*a* and 18*b* (FIG. 5). This exciting circuit 27 is enabled to generate high frequency waves ranging from 20 kHz to 500 kHz with the use of a switching electrical power source.

The exciting coil 18 generates alternating magnetic flux as it is fed with alternating electric current (high frequency electric current) supplied from the exciting circuit 27. Alternating magnetic flux generates eddy electric current within the electromagnetic induction type heat generation layer 1 of the fixing film 10 as a heating member, as will be described later. This eddy electric current generates Joule heat due to the specific resistivity of the electromagnetic induction type heat generation layer.

Referential codes 16*a* and 16*b* designate a film guiding member in the for of a trough with an approximately semicircular cross section. They are placed in contact with each other, with their open sides facing inward, forming thereby an approximately cylindrical member, around the peripheral surface of which the cylindrical fixing film 10 as the electromagnetic induction heat generating member is loosely fitted.

The film guiding member 16*a* contains the magnetic cores 17*a,* 17*b* and 17*c* and the exciting coil 18, as the magnetic field generating means. The film guiding members 16*a* and 16*b* play a role in applying pressure to the fixing nip portion, supporting the exciting coil 18 and magnetic cores 17*a,* 17*b* and 17*c,* as the magnetic field generating means, supporting the fixing film 10, and keeping the film 10 stable while the film 10 is rotationally conveyed. These film guiding members 16*a* and 16*b* should be insulative members which do not prevent the passage of magnetic flux, and therefore, material which could withstand high load is used as their material.

The film guiding member 16*a* is provided with a very thermally conductive member 40, which is located in the nip portion N, facing toward the pressure roller 30. The thermally conductive member 40 is inside the loop of fixing film 10, which is obvious.

In this embodiment, aluminum is used as the material for the thermally conductive member 40. The member 40 is 240 [$w.m^{-1}k^{-1}$] in thermal conductivity k, and 1 [mm] in thickness.

Further, the thermally conductive member 40 is disposed outside the range of the magnetic field generated by the exciting coil 18 and magnetic cores 17*a,* 17*b* and 17*c,* as the magnetic field generating means, so that it is not affected by this magnetic field.

More specifically, the thermally conductive member 40 is positioned on the opposite side of the exciting coil 18 with reference to the magnetic core 17*c*. In other words, the thermally conductive number 40 is placed outside the magnetic path of the exciting coil 18 to prevent it from being affected by the magnetic field.

A referential code 22 designates a rigid pressure application stay, which is long in the widthwise direction, and is placed in contact with the thermally conductive member 40, across the back side area correspondent to the nip portion N, and also in contact with the film guiding member 16*b*, across the flat inward surface.

A referential code 19 designates an electrically insulative member for insulting between the magnetic cores 17*a*, 17*b* and 17*c* and the rigid pressure application stay 22, and between the exciting coil 18 and the rigid pressure application stay 22.

The flanges 23*a* and 23*b* are fitted around the left and right longitudinal ends, respectively, of the assembly of the film guiding members 16*a* and 16*b*. They play a role in regulating the movement of the fixing film in the longitudinal direction of the film guiding members, by catching the fixing film 10 by their longitudinal ends, while the fixing film 10 is rotated.

The pressure roller 30 as a pressure applying member comprises a metallic core 30*a*, and an elastic layer 30*b*, which is concentrical with the metallic cure 30*a* being formed of heat resistant and elastic material such as silicone rubber, fluorinated rubbers fluorinated resin, or the like, in a manner to cover the peripheral surface of the metallic core 30*a*. It is rotationally supported between the unillustrated lateral walls of the apparatus by the longitudinal ends of the metallic core 30*a*, with the use of bearings.

Between the longitudinal ends of the rigid pressure application stay 22 and the corresponding spring seats 29*a* and 29*b* on the apparatus chassis side, pressure application compression springs 25*a* and 25*b*, respectively, are disposed in the compressed state, to generate the force for pressing downward the rigid pressure application stay 22. With this arrangement, the portion of the downwardly facing surface of the thermally conductive member 40 is pressed against the portion of the upwardly racing portion of the peripheral surface of the pressure application roller 30, with the fixing film 10 being pinched between the two surface portions, forming the fixing nip N with a predetermined width.

The pressure roller 30 is rotationally driven in the counterclockwise direction indicated by an arrow mark, by a driving means M. As the pressure roller 30 is rotationally driven, rotational force is applied to the fixing film 10 by the friction between the peripheral surface of the pressure roller 30 and fixing film 10. As a result, the fixing film 10 rotates around the peripheral surface of the outwardly facing surface of the film guiding members 16*a* and 16*b*, with the inwardly facing surface of the film 10 sliding on the downwardly facing surface or the thermally conductivity member 40, in the clockwise direction indicated by an arrow mark, at approximately the same peripheral velocity as that of the pressure roller 30, in the fixing nip N. Thus, the velocity at which the recording medium is conveyed, while being pinched, in the fixing nip N, can be changed by regulating the rotational velocity of the pressure roller 30.

With the above setup, in order to reduce the friction between the downwardly facing surface of the thermally conductive member 40 and the interior surface of the fixing film 10, within the fixing nip N, lubricant such as heat resistant grease may be fed between the downwardly surface of the thermally conductive member 40 and the interior surface of the fixing film 10, or the downwardly facing surface of the thermally conductive member 40 may be covered with a lubricous member 41. This is done to prevent the durability of the fixing film 10 from being reduced by the damage to the fixing film 10, which occurs as the fixing film 10 slides against the thermally conductive member 40, in the case that material such as aluminum, inferior in slipperiness, is used as the material for the thermally conductive member 40, or that finishing is simplified The thermally conductive member 40 is effective to make uniform the temperature distribution in the longitudinal direction. For example, when a sheet of small size is passed the heat generated in the portion of the fixing film 10, outside the path of the small size sheet, is conducted to the thermally conductive member 40, and then, is efficiently conducted through the member 40 in its longitudinal direction. In other words, the heat generated in the portion of fixing film 10, outside the path of the small size sheet, is conducted to the path of the small size sheet, reducing the power consumption.

Further, referring to FIG. 5, the film guiding 16*a* is provided with a plurality of ribs 16*e*, which are disposed on the outwardly facing peripheral surface, with predetermined intervals in terms of the longitudinal direction of the film guiding member 16*a*, to reduce the frictional resistance between the peripheral surface of the film guiding member 16*a* and the interior surface of the fixing film 10, to reduce the rotational load exerted upon the fixing film 10. A plurality of ribs such as the ribs 16*e* may be provided also on the film guiding member 16*b*.

Figure 6:
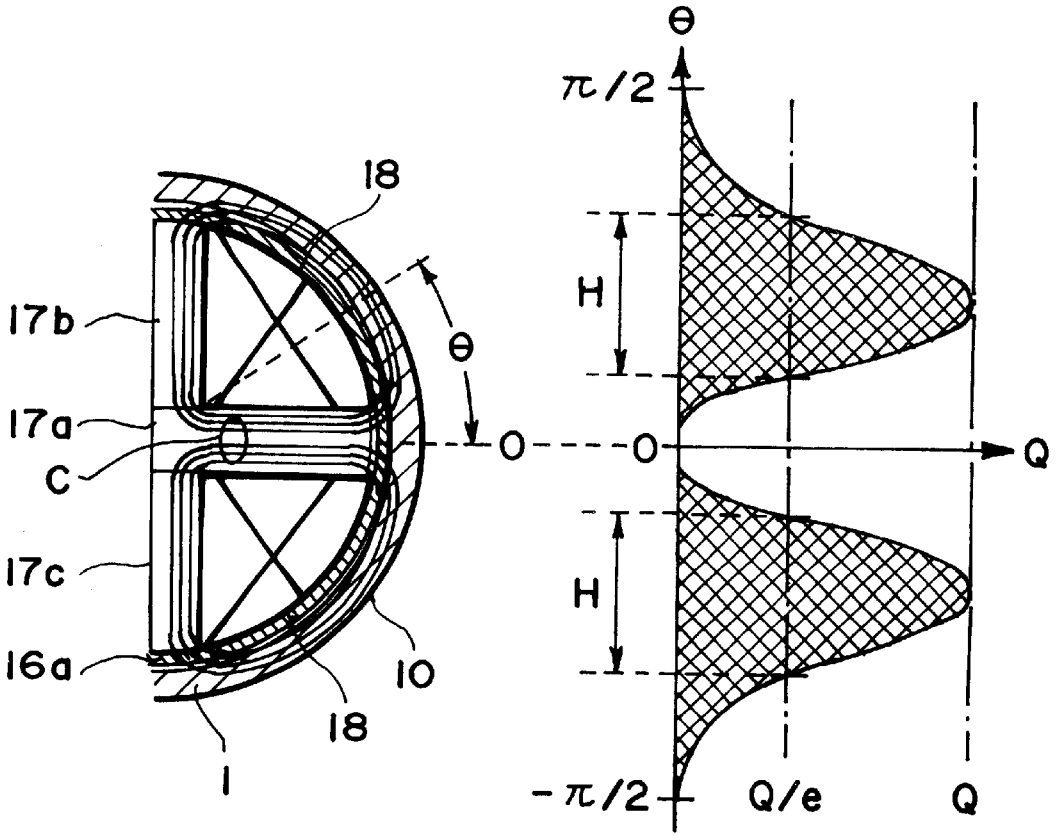
FIG. 6 is a drawing for describing the relationship between a magnetic field generating means and the amount of the generated heat.

FIG. 6 schematically shows the wakeup of magnetic flux. A magnetic flux C represents a portion of the alternating magnetic flux.

The alternating magnetic flux C guided by the magnetic cores 17*a*, 17*b* and 17*c* generates eddy electric currents in the electromagnetic induction type heat generation layer 1 of the fixing film between the magnetic cores 17*a* and 17*b*, between the magnetic cores 17*a* and 17*c*. These eddy currents generate Joule heat (eddy current logs) in the electromagnetic induction type heat generation layer 1 to the specific resistivity of the electromagnetic induction bear generation layer 1.

The amount Q of the heat is determined by the density of the magnetic flux which goes through the electromagnetic induction type heat generation layer 1, and has a distribution such as the one given in FIG. 6. In the graph in FIG. 6, the axis of ordinates represents position of a given point of the fixing film 10, in terms of the angle 9 of the line connecting the given point of the fixing film 10 and the center of the edge of the inward end of the magnetic core 17*a*, with respect to the center line of the magnetic core 17*a*, and the axis of abscissas represents the amount Q of the heat generated by the electromagnetic induction type heat generation layer 1 of the fixing film 10. In the graph a referential code H designates a heat generating region in which heat is generated by an amount no less than Q/e. Q being the maximum amount of the heat generated. In other words, the region H is region in which heat is generated by an amount greater than necessary.

The temperature in the fixing nip N is kept constant at a predetermined level as the amount of electric current supplied to the exciting coil 18 is controlled by a temperature controlling system inclusive of a temperature detecting means 26.

The temperature detecting means 26 is a temperature sensor such as a thermistor for detecting the temperature of the fixing film 10. In this embodiment, the temperature in the fixing nip N is controlled based on the temperature of the fixing film 1 measure by the temperature sensor 26.

In this embodiment the level at which the temperature of the fixing nip N is kept constant can be changed according to the recording medium conveyance velocity, through an unillustrated control circuit (CPU) provided on the image forming apparatus main assembly side.

In operation, as the fixing film 10 is rotationally driven, electrical power is supplied to the exciting coil 18 from the exciting circuit 27 so that heat is electromagnetically reduced in the fixing film 10, increasing the temperature of the fixing nip portion N to the predetermined level, and stabilizing it at the predetermined level, as described above. Then, the recording medium P, on which an unfixed toner image t has been formed, is conveyed from the image forming means portion to the fixing nip portion N, and introduced between the fixing film 10 and pressure roller 30, with the image side of the recording medium P facing upward, that is, facing he fixing film 10. Then, the recording medium P is moved, being pinched between the fixing film 10 and pressure roller 30, through the fixing nip portion N, together with the fixing film 10, with the image bearing side of the recording medium P remaining tightly in contact with the outwardly facing surface of the fixing film 10.

While the recording medium P is conveyed through the fixing nip portion N, being pinched between the fixing film 10 and pressure roller 10, together with the fixing film 10, it is heated by the heat electromagnetically induced in the fixing film 10. As a result, the unfixed toner image t on the recording medium P is thermally fixed.

After being conveyed through the fixing nip portion N, the recording medium P is separated from the outward facing surface of the fixing film 10, and is further conveyed to be discharged.

Also after being conveyed through the fixing portion N, the thermally fixed image on the recording medium P cools down, and becomes a permanently fixed image.

Referring to FIG. 2, in this embodiment, a thermo-switch as a temperature detecting element for shutting off the power supply to the exciting coil 18 during a runaway is disposed adjacent to the peripheral surface of the fixing film 10, within the region H (FIG. 6) in which a sufficient amount of heat is generated by the fixing film 10.

Figure 7:
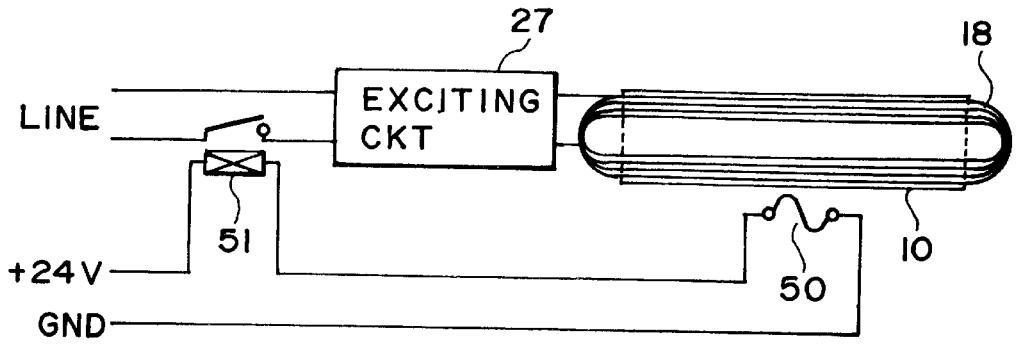
FIG. 7 is a safety circuit diagram.

FIG. 7 is a diagram of the safety circuit employed in this embodiment. The thermo-switch as a temperature detecting element is serially connected to a 24 V DC power source and a relay switch 51. As the thermo-switch is turned off, the power supply to the relay switch 51 is shut off, causing the relay switch 51 to operate to shut off the power supply to the exciting circuit 27, which in turn shuts off the power supply to the exciting coil 18. The temperature at which the thermo-switch is turned off is set at 220° C.

Further, the thermo-switch 50 is disposed adjacent to the peripheral surface of the fixing film 10, at position within a range correspondent to the region within which a sufficient amount of heat is generated by the fixing film 10, with no contact between the thermo-switch 50 and the fixing film 10. The distance between the thermo-switch 50 and fixing film 10 was set at approximately 2 mm. With this arrangement, it does not occur that the fixing film 10 is damaged through the contact, between the fixing film 10 and the thermo-switch 50. Therefore, it is possible to prevent image quality from decreasing us the length of the usage of the image forming apparatus increases.

According to this embodiment, heat is not generated in the fixing nip portion N, which is different from a fixing apparatus structured so that heat is generated in the fixing nip portion N. Therefore, even if the fixing apparatus 100 runs away due to something amiss, for example even if the power supply to the exciting coil 18 is continued, and therefore, the fixing film 10 keeps on generating heat, after the fixing apparatus 100 stops with a sheet of recording medium remaining stuck in the fixing nip portion N, the sheet is net directly heated, b use no at is generated in the fixing nip portion N in which the sheet is stuck. Further, since the thermo-switch 50 is disposed adjacent to the peripheral surface of the fixing film 10, within the region H in which a sufficient amount of heat is generated, the thermo-switch 50 senses the temperature of 220° C., and as the thermo-switch 50 is shut off, the power supply to the exciting coil 15 is shut off by the relay switch 51.

Thus, the heat generation by the fixing film 10 is stopped before the sheet of recording medium, the ignition point of which is approximately 400° C., ignites.

Obviously, a temperature fuse may be employed as a temperature detection clement, instead of the thermo-switch 50.

In this embodiment, a type of toner which contains a substance with a low softening point is used as the toner t. Therefore, the fixing apparatus is not provided with a mechanism for coating oil for preventing offset. However, if toner which does not contain a substance with a low softening point is used, an oil coating mechanism may be provided. Further, even when toner which contains a substance with a low softening point is used, oil coating as well as separation cooling may be done.

B) Exciting Coil 18

For the electrically conductive wire for the exciting coil 18, a bundle or plural pieces of fine copper wires individually covered with electrically insulative material is used. This bundle of fine wires is wound a few times to form the exciting coil. In this embodiment, the bundle of wires was wound ten times to form the exciting coil 18.

In consideration of the transmission of the heat generated by the fixing film 10, it is desired that heat resistant and electrically insulative material, for example, amide-imide or polyimide, used as the coating material for the wires of the exciting coil 18.

The wire density or the exciting coil 16 may be increased by the application of external pressure.

Referring to FIG. 2, the wires of the exciting coil 18 are wound in such a manner that the cross sectional contour of the exciting coil 18 follows the curvature of the heat generating layer of the fixing film. In this embodiment, the distance between the heat generating layer 1 of the fixing film 10 and the exciting coil 18 is set at approximately 2 mm.

The materiel for the film guiding members 16*a*and 16*b* exciting coil holding members) is desired to be excellent in electrical insulation and also is heat resistant. For example, it is desired that the material is selected from among phenol resin, fluorinated resin, polyimide resin, polyamide resin, polyamide-imide resin, PEEK resin, PES resin, PPS resin, PPA resin, PTFE resin, REP resin, LCF resin, and the like.

The smaller the distances between the magnetic cares 17*a*, 17*b* and 17*c* and the heat generating layer 1 of the fixing film 10, and between the exciting coil 18 and the heat generating layer 1 of the fixing film 10, the higher the ratio at which the magnetic flux is absorbed. However, if these distances exceed 5 mm, the absorption ratio drastically reduces, and therefore, the distances should be set to no more then 5 mm. It should be noted bare that the gap between the neat generating layer 1 of the fixing film 10 and the exciting coil 18 does not need to be uniform long as the gap is no more than 5 mm.

The lead wires from the film guiding member 16*a* of the exciting coil 18, that is, the power supplying portions 18*a* and 18*b* (FIG. 5), are coated with electronically insulative material, across the portions extending outward from the film guiding member 16*a*.

C) Fixing Film 10

Figure 8:
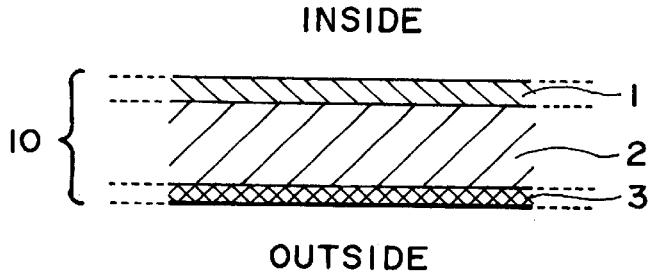
FIG. 8 is a schematic drawing for depicting the laminar structure (1) of the fixing film which generates heat through electromagnetic induction.

FIG. 8 is schematic section of the laminar fixing film 10 as a heating member in this embodiment, and depicts the structure of the film. The fixing film 10 has a compound structure, comprising the heat generating layer 1, which is formed of metallic film, or the like, capabble of electromagnetically inducing heat, and which serves as a base layer, and an elastic layer 2 laid on the outward facing surface of the heat generating layer 1, and a mold release layer 3 laid on the outwardly facing surface of the elastic layer 2.

A printer layer (unillustrated may be provided between the heat generating layer 1 and elastic layer 2, and between the elastic layer 2 and mold release layer 3, to bond them.

The fixing film 10 is approximately cylindrical. The heat generating layer 1 and mold release layer 3 constitute the innermost and outermost layers, respectively.

As described above an alternating magnetic flux acts on the heat generating layer 1, eddy generates in the heat generating layer 1. As a result, the heat generating layer 1 generates Heat. This heat heats the fixing film 10 through the elastic layer 2 and mold release layer 3, which in turn heats the recording medium P, that is, on heating target, which is passed through the fixing nip N. As a result, the toner image is thermally fixed.

a. Heat Generating Layer 1

As for the material for the heat generating layer 1, ferromagnetic metal such as nickel, iron, ferromagnetic SUS, a nickel-cobalt alloy, and the like, is recommended.

Although nonmagnetic material may be used as the material for the heat generating layer 1, metallic material such as nickel, iron, magnetic stainless Steel, cobalt-nickel alloy, and the like, which is superior in magnetic flux absorbency, is preferable.

The thickness of the heat generating layer 1 is desired to be greater than the surface skin depth σ (mm) expressible by the following formula, and no more than 200 μm:

$$\sigma=503\times(\rho/f\mu)^{1/2}$$

ρ[ohm, cm]: specific resistivity of exciting circuit 27 f [Hz]: frequency [Hz] of exciting circuit 27

μ: permeability of exciting circuit 27

Figure 9:
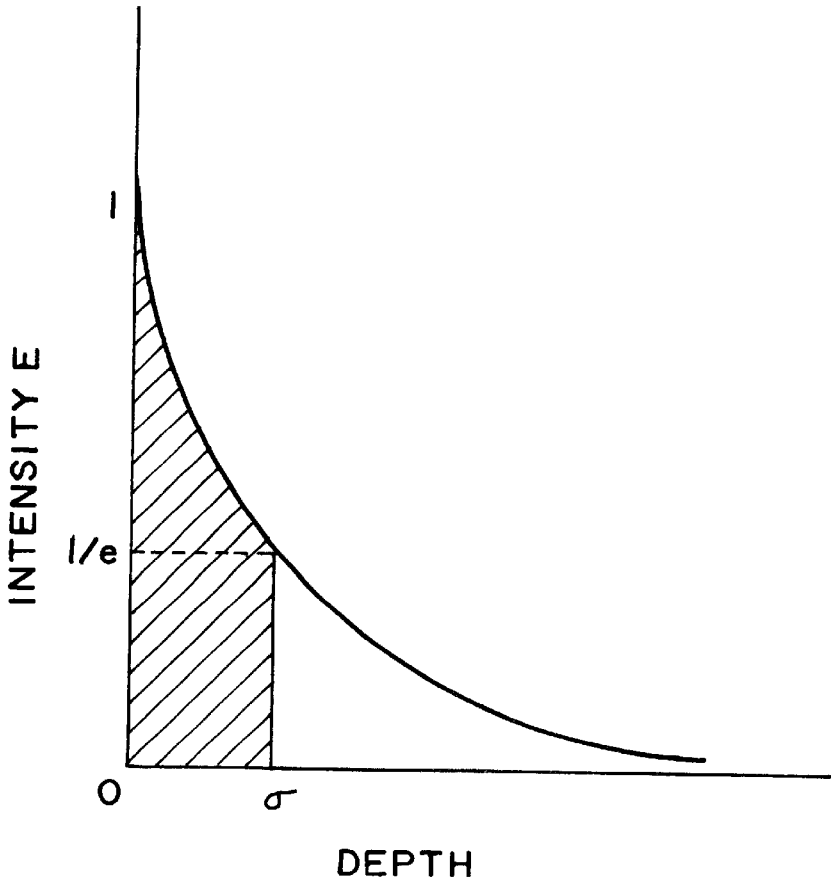
FIG. 9 is a graph which shows the relationship between the depth of the heat generating layer and the intensity of the electromagnetic waves.

This shows the electromagnetic wave absorption depth, which is use in the field of electromagnetic induction. In the region below the depth calculated by the above formula the intensity of the electromagnetic waves is no more than 1/e. Conversely most of the energy is absorbed before it reaches this depth (FIG. 9).

It is desired that the thickness of the heat generating layer 1 is in a range of 1–100 μm. If the thickness of the heat generating layer 1 is no more than 1 μm, efficiency is poor because all the electromagnetic energy cannot be absorbed. On the contrary, if the thickness of the heat generating layer exceeds 100 μm, the rigidity of the heat generating layer 1 becomes excessively high, becoming inferior in flexibility in other words, making the heat generating layer 1 thicker than the above range makes it impractical to use the heat generating layer 1 rotational member. Therefore, the thickness of the heat generating layer 1 is desired to be in the range of 1–100 μm.

b. Elastic Layer 2

As for the material for the elastic layer 2, such material that is superior in heat resistance and thermal conductivity, for example, silicone rubber, fluorinated rubber, fluorinated silicone rubber, of the like, is recommended.

The thickness of the elastic layer 2 is desired to be in a range of 10–500 μm. In order to ensure the quality of a fixed image, it is necessary for the thickness of the elastic layer 2 to be in this range.

When printing a multi-color image, in particularly, a photographic multi-color image, a large area of a solid image is created across the recording medium P. In such case. If the heating surface (mold release layer 3) cannot follow the ridges and valleys in the surfaces of the recording medium P or a toner layer the surfaces are nonuniformly heated, creating difference in gloss among the areas which receive more heat and the areas which receive less heat. The areas which received more heat will be higher in gloss, whereas the areas which received less heat will be low in gloss.

If the thickness of the elastic layer 2 is no more than 10 μm, the fixing film 10 fails to follow the ridges and valleys in the surfaces of the recording medium or toner layer, resulting in a nonuniform image in terms of gloss. If the elastic layer 2 is no less than 1000 μm thick, the thermal resistance of the elastic layer is rather high, making "quick start" difficult. Thus, it is preferable that the thickness of the elastic layer 2 is within a range of 50–500 μm.

If the hardness of the elastic layer 2 is excessively high, the fixing film 10 fails to conform to the ridges and valleys in the surfaces of the recording medium or toner image, resulting in a nonuniform image in terms of gloss. Thus, the hardness of the elastic layer 2 is desired to be no more than 60 deg., preferably, no more than 40 deg. (in the hardness scale JIS-A, that is, A-type hardness meter in accordance with JIS-K6301).

The thermal conductivity λ of the elastic layer 2 is desired to be in a range of $6\times10^{-4}$–$2\times10^{-3}$ [cal/cm.sec.deg.].

If the thermal conductivity λ of the elastic layer 2 is smaller than $6\times10^{-4}$ [cal/cm.sec.deg.], the thermal resistance is excessively large, resulting in delay in the temperature increase of the surface layer (mold release layer 3) of the fixing film.

If the thermal conductivity λ of the elastic layer 2 is larger than $2\times10^{-3}$ [cal/cm.sec.deg.], the hardness becomes excessively high or permanent compression set becomes worse.

Thus, the thermal conductivity λ is desired to be in the range of $6\times10^{-4}$–$2\times10^{-3}$ [cal/cm.sec.deg.], preferably in a range of $8\times10^{-4}$–$1.5\times10^{-3}$ [cal/cm.sec.deg.].

a. Mold Release Layer 3

As for the material for the mold release layer 3, such material that is excellent in mold release property and beat resistance may be selected; for example, fluorinated resin, silicone resin, fluoro-silicone rubber fluorinated rubber, silicone rubber, or PFA, PTFE, FEP, and the like.

The thickness of the mold release layer 3 is desired to be in a range of 1–100 μm. If the thickness of the mold release layer 3 is no more than 1 μm, there is a possibility that the mold release layer 3 is nonuniform in thickness, and therefore, some portions of the mold release layer 3 are inferior in mold release property or durability. If the mold release layer 3 is no less than 100 μm thick, there is a problem that thermal conductivity is inferior. In particular, in the case that the material of the mold release layer is resinous, hardness becomes excessively high, canceling the effect of the elastic layer 2.

Figure 10:
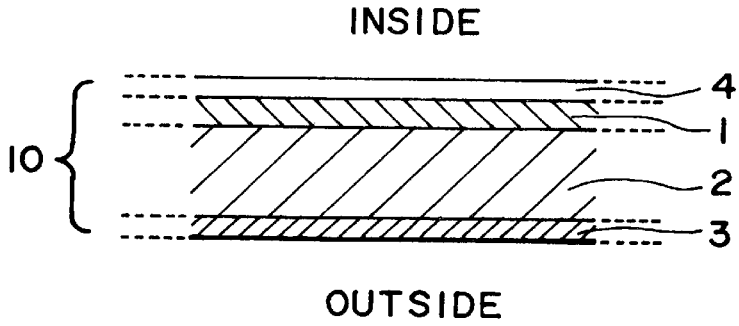
FIG. 10 is a schematic drawing for depicting the laminar structure (2) of the fixing film which generates heat through electromagnetic induction.

Referring to FIG. 10, regarding the structure of the fixing film 10, the fixing film 10 may be provided with a thermally insulative layer 4, which is to be laid on the surface of the heat generating layer 1, on the surface of the heat generating layer 1, on the side opposite to the elastic layer 2.

As for the material for the heat insulating layer 4, heat resistant resin is recommendable; for example, fluorinated resin, polyimide resin, polyamide resin, polyamideimide resin, PEEK resin, PES resin, PPS resin, PFA resin, PTFE resin, FEP resin, and the like.

It is desired that the thickness of the heat insulating layer 4 is in a range of 10–1000 μm. If the thickness of the heat insulating layer 4 is no more than 10 μm the heat insulating effect cannot be obtained, and also, durability is insufficient. On the other band, if the thickness of the heat insulating layer 4 exceeds 1000 μm, the distances from the magnetic cores 17*a*, 17*b* and 17*c*, and the exciting coil 18, to the heat generating layer 1 become large, and therefore, the magnetic flux is not sufficiently absorbed by the beat generating layer 1.

With the provision of the heat insulating layer 1, the heat generated in the heat generating layer 1 is impeded from conducting inward with respect to the loop of the fixing film 10. Therefore, compared to a fixing film with no heat insulating layer 4, the fixing film with the heat insulating layer 4 is superior in terms of the amount of the neat conducted toward the recording medium F, reducing the amount of electric power consumption.

In order to ensure that a full-color image which is greater in the amount of toner per unit area is satisfactorily fixed, the nip width of the fixing apparatus of a full-color image forming apparatus is desired to be at least 7.0 mm or greater. If it is less than this, it is impossible for the unfixed toner and the recording medium to be supplied with a sufficient amount of heat, and therefore, fixation failure occurs.

Further, in order to ensure that a full-color image on a sheet of OHP film becomes satisfactorily transparent, the surface pressure of the nip portion is desired to be no less than 0.8 kgf/cm$^2$. If it is less than this, the surface of the toner layer cannot be satisfactorily flattened as the toner layer is fixed. Therefore, the amount of irregularly reflected light increases, reducing thereby the amount of the light transmitted through the image portion of the OHP film.

In consideration of the above viewpoint, in the case of the fixing apparatus in this embodiment, the pressure roller 30 and fixing film 10 are compressed against each other with the application of a pressure of 21 kgf, creating a fixing nip with a width of approximately 8.0 mm and a surface pressure of 1.2 kgf/cm$^2$ (length of the nip is 220 mm).

High Frequency Invertor

Figure 16:
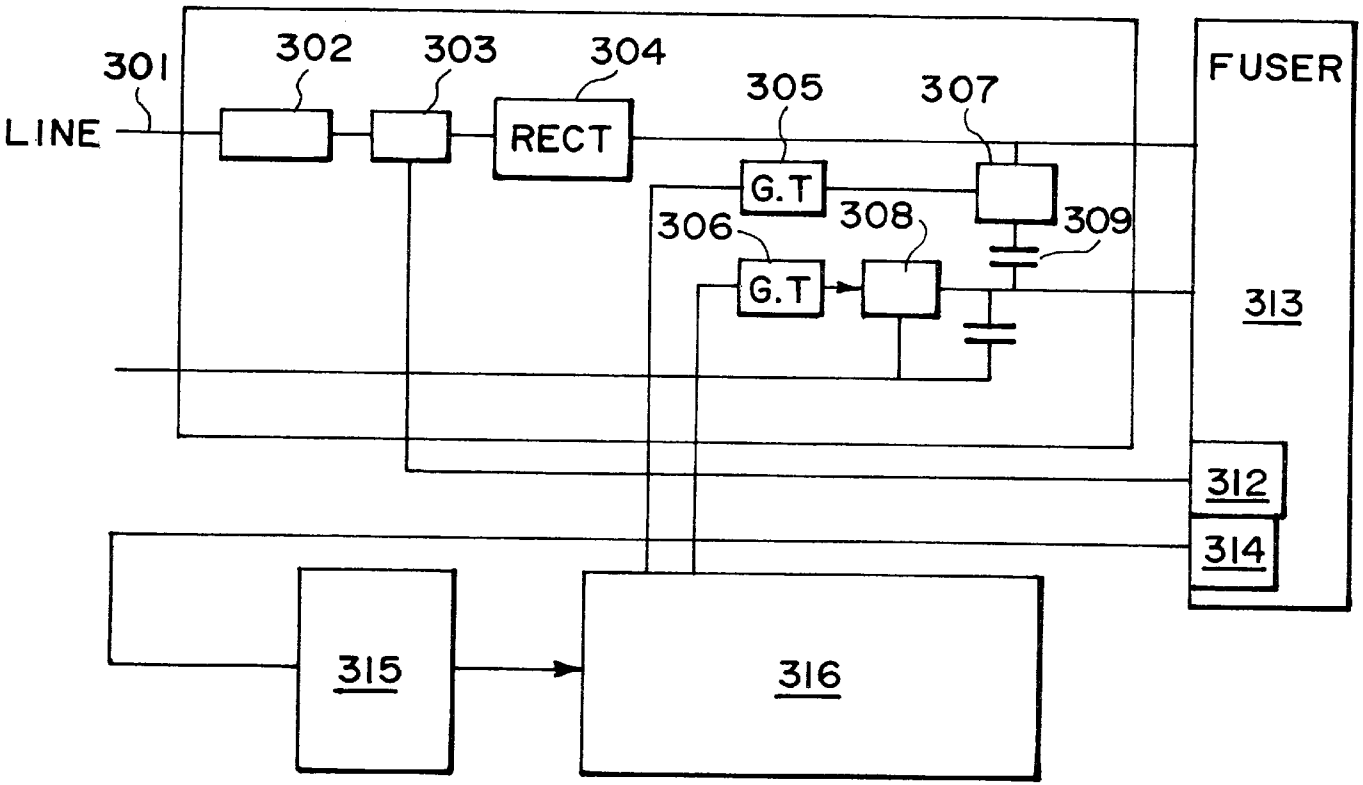
FIG. 16 is a block diagram for depicting the general structure of the induction heating control section.
Figure 17:
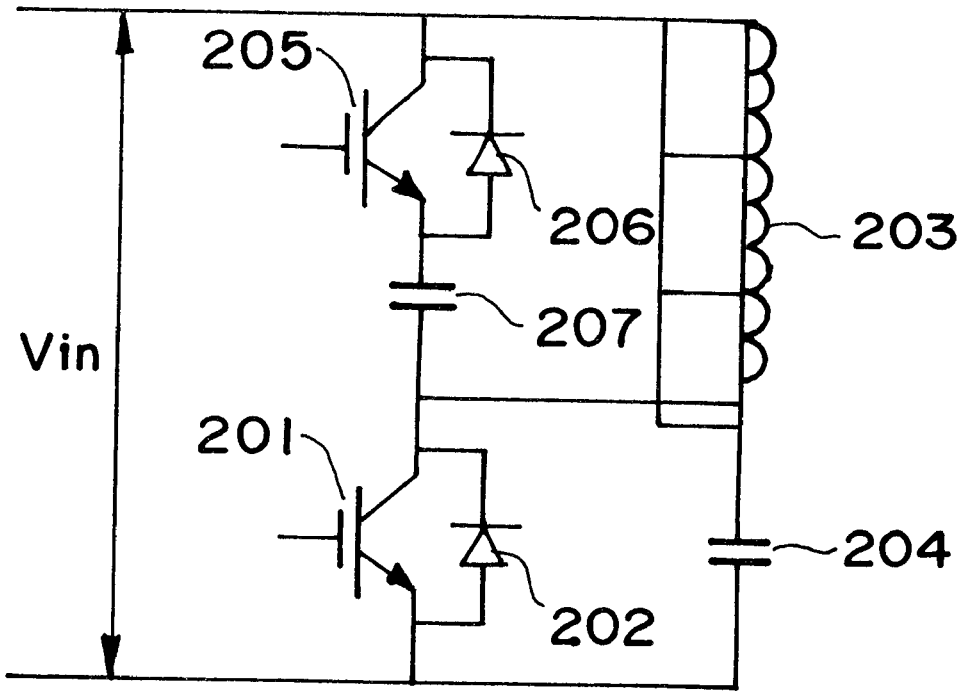
FIG. 17 is the circuit diagram of the high frequency invertor illustrated in FIG. 16.

FIG. 16 is a block diagram which shows the overall structure of the induction heating control section inclusive of the high frequency invertor circuit illustrated in FIG. 17.

Hereinafter the operation of the circuit will be described. A referential code 301 designates an electric power source line input terminal 302, a circuit breaker; 303, a relay; 304, a rectifying circuit comprising a bridge rectifying circuit which bidirectionally rectifies alternating currant input, and a condenser which filters high frequency waves; 305 and 306, gate control transformers; 307, a primary switch element 308, a secondary switch element; 309, a resonance condenser; and a referential code 310 designates a secondary resonance condenser. Designated by a referential code 313 is a fixing device unit, which comprises, in terms of electrical component structure, the exciting coil described above, a temperature detection thermistor, and a thermo-switch 312 for detecting excessively high temperature. A referential code 314 designates a thermistor as temperature detecting element.

Designated by a referential code 315 is a feedback circuit which regulates the amount of control, in comparison to a target temperature, based on the temperature value detected by the thermistor 314 of the fixing device. Designated by a referential code 316 is a driver circuit which controls the apparatus accordance with the control modes of this converter.

As for the types of the switching elements 307 and 308, an electric power switch element for electrical power is most suitable. In this embodiment, they comprise a PET or IGBT (+reversely conducting diode). Since they control resonant current, they are desired to be small in steady-state loss as well as switching loss, and be capable of dealing with high pressure and large current.

As AC voltage is applied to the rectifying circuit 304 through the electric power supply line input terminal, excess current breaker, and relay, pulsating DC voltage is generated by the bidirectionally rectifying diode.

As the gate transformer 305 is driven so that the switching element 307 per forms switching, pulsating AC voltage is applied to the resonant circuit comprising the exciting coil 303 and resonance condenser 309. As a result, when the switching element 308 is in the conductive state, pulsating DC voltage is applied to the exciting coil, causing electrical current, the properties of which are determined by the inductance and resistance of the exciting coil, to begin flow. As the switching element is turned off in accordance with a gate signal, the exciting coil continues to act to flow the current, and therefore, high voltage called fly-back voltage is generated between the two terminals of the switching elements, by the acuteness Q of the resonant circuit determined by the resonance condenser and exciting coil. This voltage oscillates with reference to the electrical power source voltage, and with the switching element remaining in the off-state, it converges to the electrical power source voltage.

While the oscillation of the fly-back voltage remains large, and the voltage at the coil side terminal of the switching element remains negative, the reversely conducting diode is turned on, allowing electric current to flow into the coil. During this period, the contact point between the coil and switching element is clamped to 0 V. It is generally known that during this period, the switching element can be turned on without carrying voltage. This type of switching is called ZVS (Zero Voltage Switching). With the use of this type of driving method, the loss traceable to the process of turning on or off the switching element can be minimized, and the switching element can be efficiently turned on or off, with minimum switching noise.

Temperature Control

In this embodiment, a digital PID control is described as an example of temperature control in accordance with the present invention. The fixation temperature of the fixing device is detected by the thermistor 314, which is located at a position on the downstream side with reference to the fixing nip, being kept pressed upon the inward aids of the sleeve, so that the amount of heat rubbed by the sheet of recording medium is measured as the amount of temperature change. The change in the electrical resistance of the thermistor 314 is converted into electrical voltage by the detection circuit, and is compared to a predetermined reference voltage, to detect it as the amount of deviation from the target temperature (target voltage). Based on the results of this detection, the duration of the period in which the switching element is kept in the on-state is determined to carry out PWM control. The portion which carries out PWM control comprises a pair of control sections, that is, an ON-period control section and OFF-period control section, and comparator. Each control section comprises a constant current power source circuit and a condenser. The duration is controlled based on the phenomenon that as the condenser is charged with the constant current from the constant current power source circuit, voltage exceeds the reference value. In order to prevent an element other than the primary switch element from being turned on during the ON-period, the OFF-period control portion is turned off during the ON-period, and the ON-period control portion is turned off during the OFF-period. The ON-period and OFF-period, the duration of which are sequentially controlled, are outputted by a steering flip-flop. The comparator of the OFF-period control portion can be adjusted. However, it is rendered constant by the provision of a structure with no feedback loop, and the electric power is controlled by varying the input voltage of the comparator of the ON-period control portion.

In FIG. 17, a referential code 201 designates a switching element. Generally, an MOSFET or an IGBT is used as the switching element 201. A referential code 202 designates a reversely conducting diode; 303, an exciting coil; 204, a resonant coil; 205, a secondary switch element; 206, a reversely conducting diode parallelly connected to the secondary switch element; and a referential code 207 designates a secondary resonance condenser. In the normal state, the switch element 205 is kept open, and in this state, the switch element 201 is turned on and off to cause single voltage resonance. While the primary switch element is off, this sub-resonance switch 205 may continue the aforementioned operation, that is, turning on toward the and of the climbing of the fly-back voltage and turning off toward the end of the falling off of the fly-back voltage.

Electric Power Control

Figure 18:
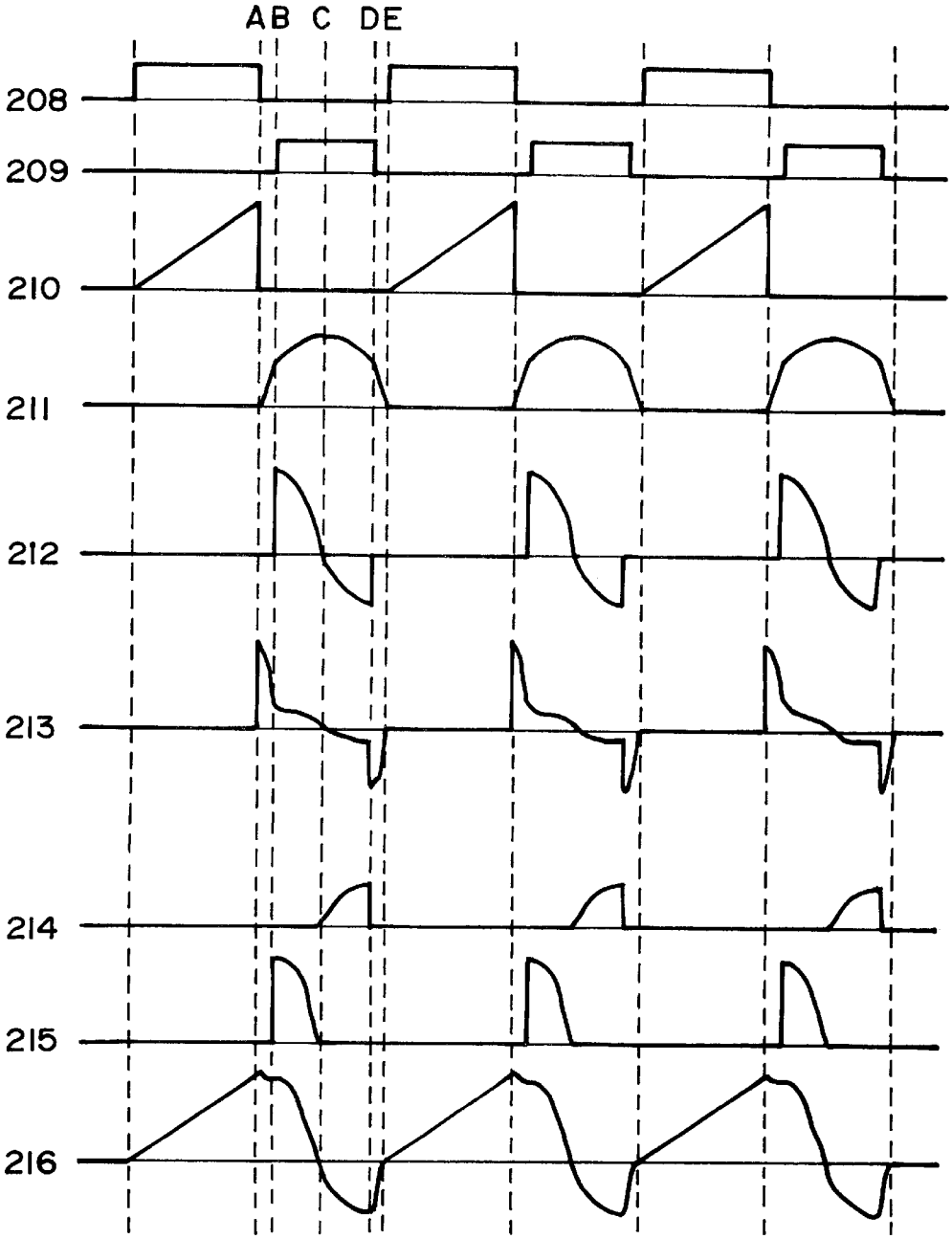
FIG. 18 is a graph which shows the operational waveform patterns in the high frequency invertor circuit.

FIG. 18 shows the operational wave-form of the circuit structure in this embodiment.

Designated by a referential code 208 is the gate voltage wave-form of switching element 201; 209, the gate voltage wave-form of the switching element 205; 210, the currant wave-form of the switching element 201; 211, the voltage wave-form of the switching element 201; 212, the current wave-form of the switching element 205; 215, the current wave-form of the rectifying element 202; and designated by a reference code 216 is the exciting current wave-form of the exciting coil 203.

First, as the switching element 201 is turned on, induction current having the wave-form 210 is flowed through the exciting coil 203 by the electrical power source. As soon as the current declines to zero (point A), the exciting coil 203 generates the fly-back voltage 211 in the direction to maintain the current flow.

In the case of the method in this embodiment, there is a difference in residual electric charge between the resonance condensers 204 and 207 (effect of the residual electric charge of the condenser 207, which will be described later). Therefore, immediately after the switching element 201 is turned off, the fly-back voltage assumes an arc-like wave-form definable by the resonance frequency $\omega(=1\sqrt{(L\times C)}$ which is determined by the resonance condenser 204 and exciting coil 203. It is assumed here that the capacity of the resonance condenser 204 is set at approximately 1/10 the capacity of the resonance condenser 207. Thus, immediately after the switching element 201 is turned off, the fly-back voltage is generated for a brief period (period A-B). The oscillation of this fly-back voltage turns on a regenerative diode 206 at a point (B) when the fly-back voltage has climbed to the initial charge voltage level of the resonance condenser 307, and then, the voltage assumes a gentle sinusoidal wave-form due to the compound capacity of the resonance condensers 204 and 207 for a longer period (period B-C). The currents of the resonance condenser 207 and regenerative diode 206 during this period are designated by referential codes 212 and 215, respectively. The current of the resonance condenser 204 is designated by the referential code 213. The fly-back voltage climbs with the elapse of time, reaching the maximum point (C) after the elapse of ¼ the longer period. On the other hand, in the case of the current wave-form 212, the current value at the maximum voltage point (C) is minimum (zero cross point), because current in the form of cosine waves equivalent to the differential wave-form of the voltage waveform, flows. Past the zero cross point, the regenerative diode 206 is turned off, and therefore, the gate of the switching element 205 is turned on to regenerate the current (period C-D). The current wave-form of the switching element 205 during this period is designated by a referential code 214. At a point (D) when the switching element 205 is turned off, the fly-back voltage begins to resonate with the small capacity condenser 204 separated from the resonance condenser 207, assuming an arc-like wave-form for a brief period (period D-E). Through the above described operational sequence of the switching element, the current which flows through the exciting coil 203 changes in the pattern designated by a referential code 216.

The peak value i (point A) of the current which flows through the exciting oil 203 can be expressed by the following formula:

$$i=(1/L)\times Vin\times Ton$$

A: inductance of exciting coil

Vin: input voltage to high frequency invertor circuit

Ton: duration of switch-on period of switching element 201

Figure 19:
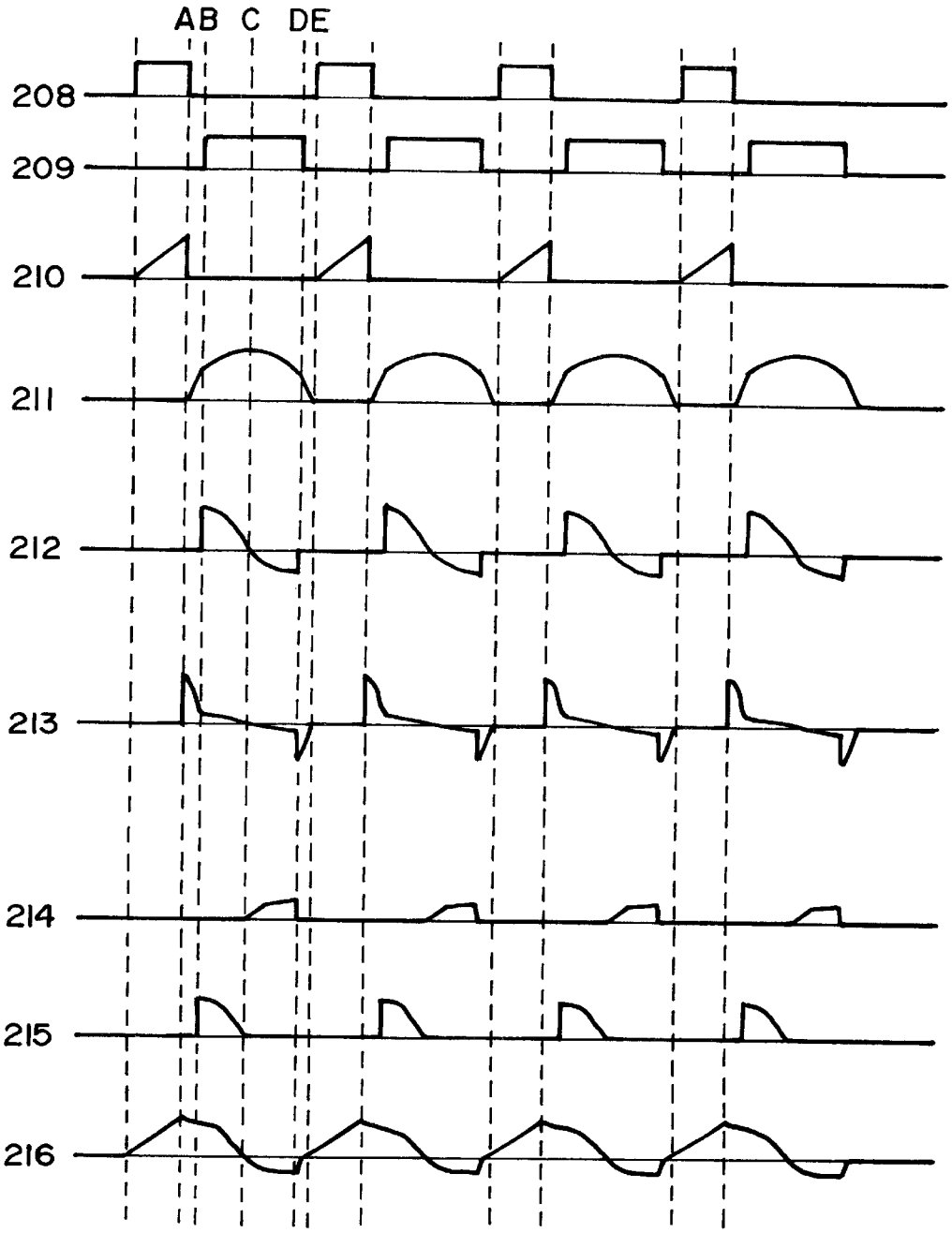
FIG. 19 is a graph which also shows the operational wave-form patterns in the high frequency invertor circuit.

As is evident from the above formula, the peak value increases in proportion to the duration of the period in which the switching element 201 is kept on. Thus, if the length of the switch-off period of the switching element 201 is rendered constant so that it matches the oscillation period of the fly-back voltage, the peak value i (point A) of the current which flows through the exciting coil 203, and the duty of the ON-period relative to the OFF-period (fixed), can be increased by increasing the length of the time the switching element is kept on, and therefore, the electric power stored in the exciting coil can be increased. Thus, the electric power put into the fixing device can be controlled by varying the length of the time the switching element 201 is kept on, in other words, by varying the frequency. The feedback control circuit 315 regulates the electric power put into the exciting coil, according to the amount of the deviation of the temperature detected by the thermistor, from the target temperature (preset temperature) of the heating member. As the target temperature is changed, the amount of the deviation or the temperature from the target temperature, detected by the thermistor, also changes, and therefore, the feedback control circuit sets up the duration of the time the switching element 201 is kept on, according to the amount of this deviation. FIG. 19 shows the operational wave-form of the circuit structure in this embodiment when the target temperature is lowered, that its, when the amount of the deviation of the detected temperature from the target temperature became smaller than the deviation in FIG. 18. As is evident from FIG. 19, as the amount of the deviation becomes smaller, the length of the time the switching element 201 is kept on becomes shorter.

D) Thermal Responsivity

The fixing apparatus described above is enabled to cause the fixing film to directly generate heat by using the generation of induction current. Therefore, it is superior to a heat roller type fixing apparatus which uses a halogen lamp as a heat source, in terms of fixation efficiency and also thermal responsivity.

Further, in the fixing apparatus in this embodiment, the pressure to be applied can be set at a higher value than in a film heating type fixing apparatus which employs a ceramic heater, because of the structure of the fixing apparatus in this embodiment.

Figure 11:
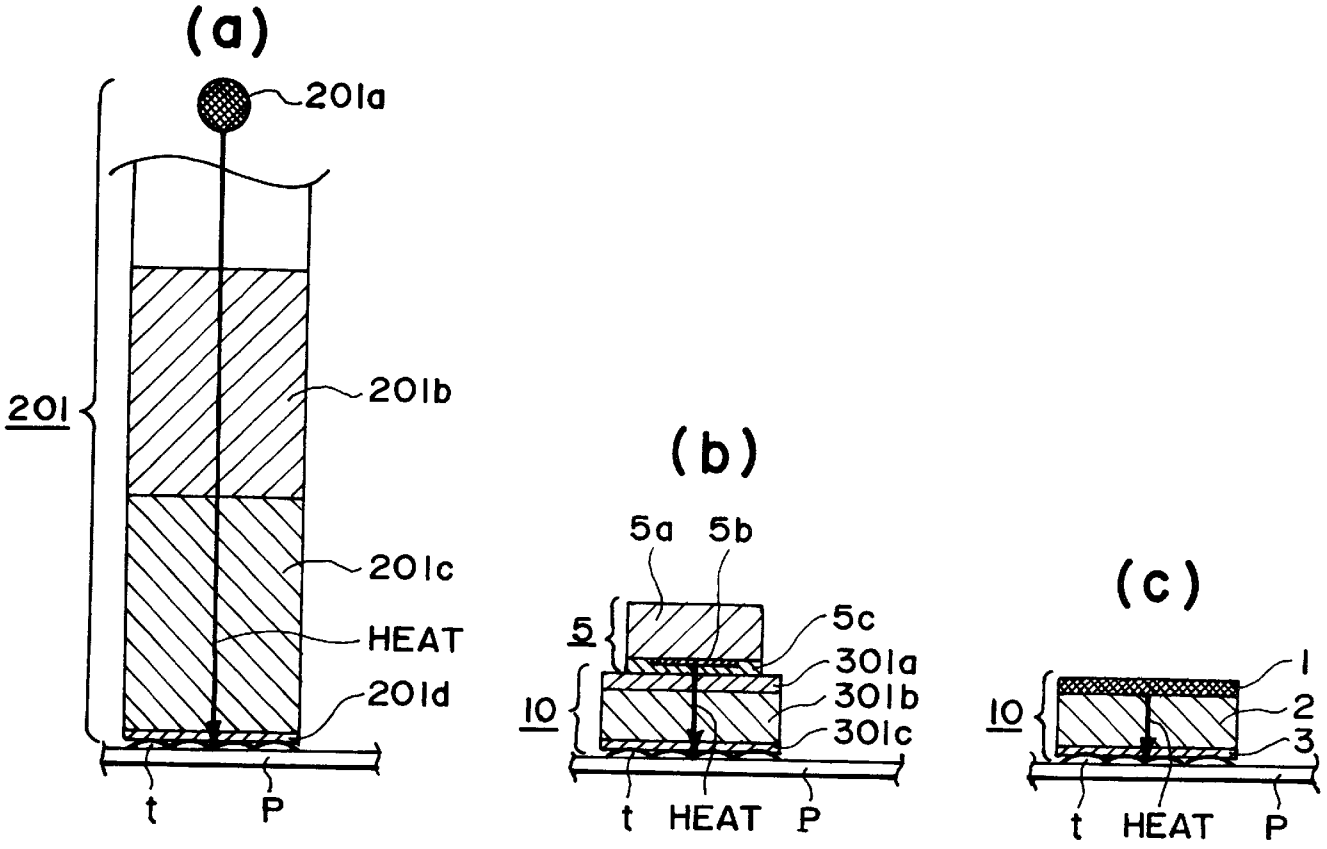
FIG. 11 is a schematic drawing which shows the positional relationship between the heat source and recording medium, in each of the various fixing apparatuses.
Figure 14:
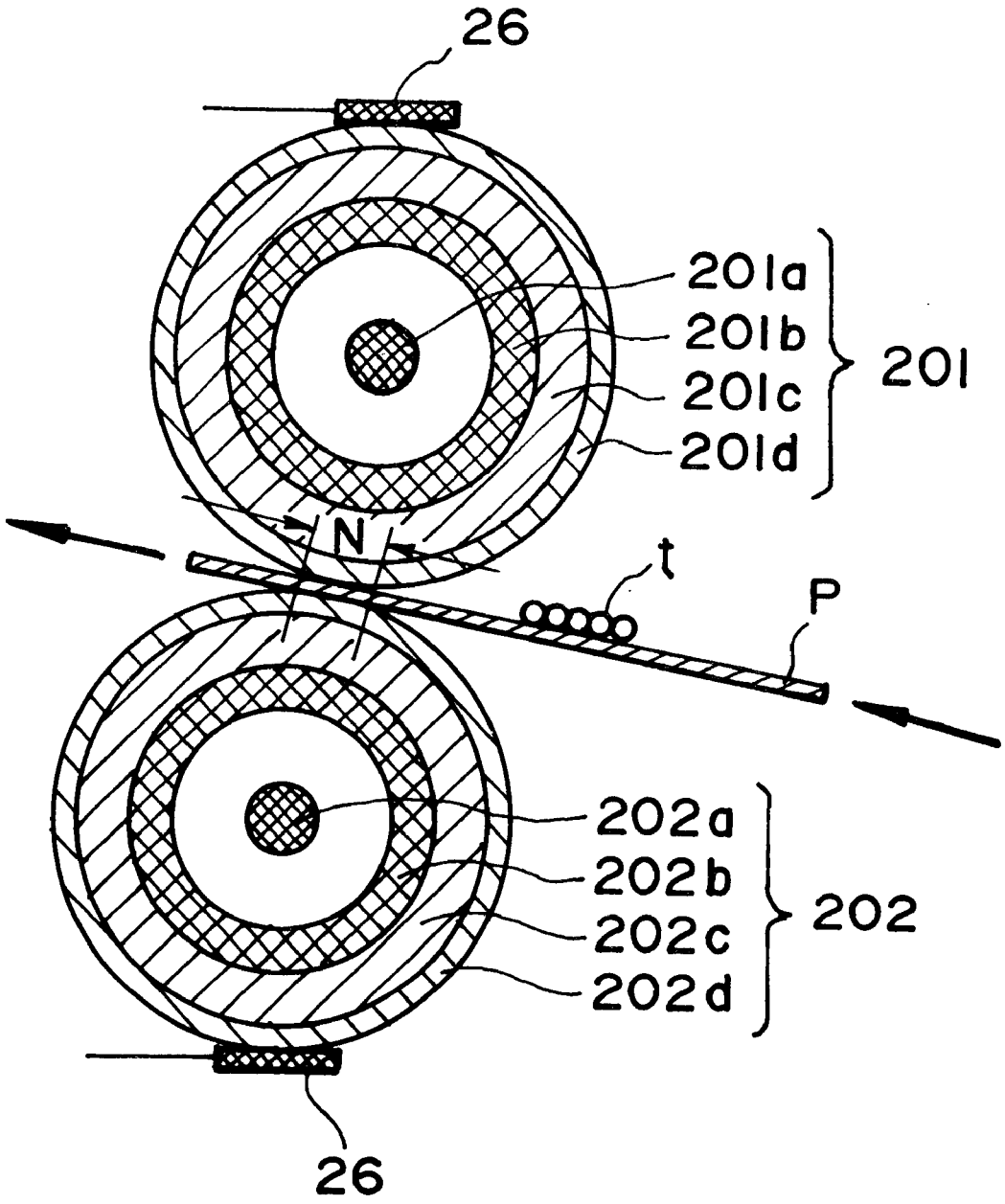
FIG. 14 is a schematic section view of an example of a fixing apparatus based on a thermal roller, at a plane perpendicular to the axes of the thermal rollers.
Figure 15:
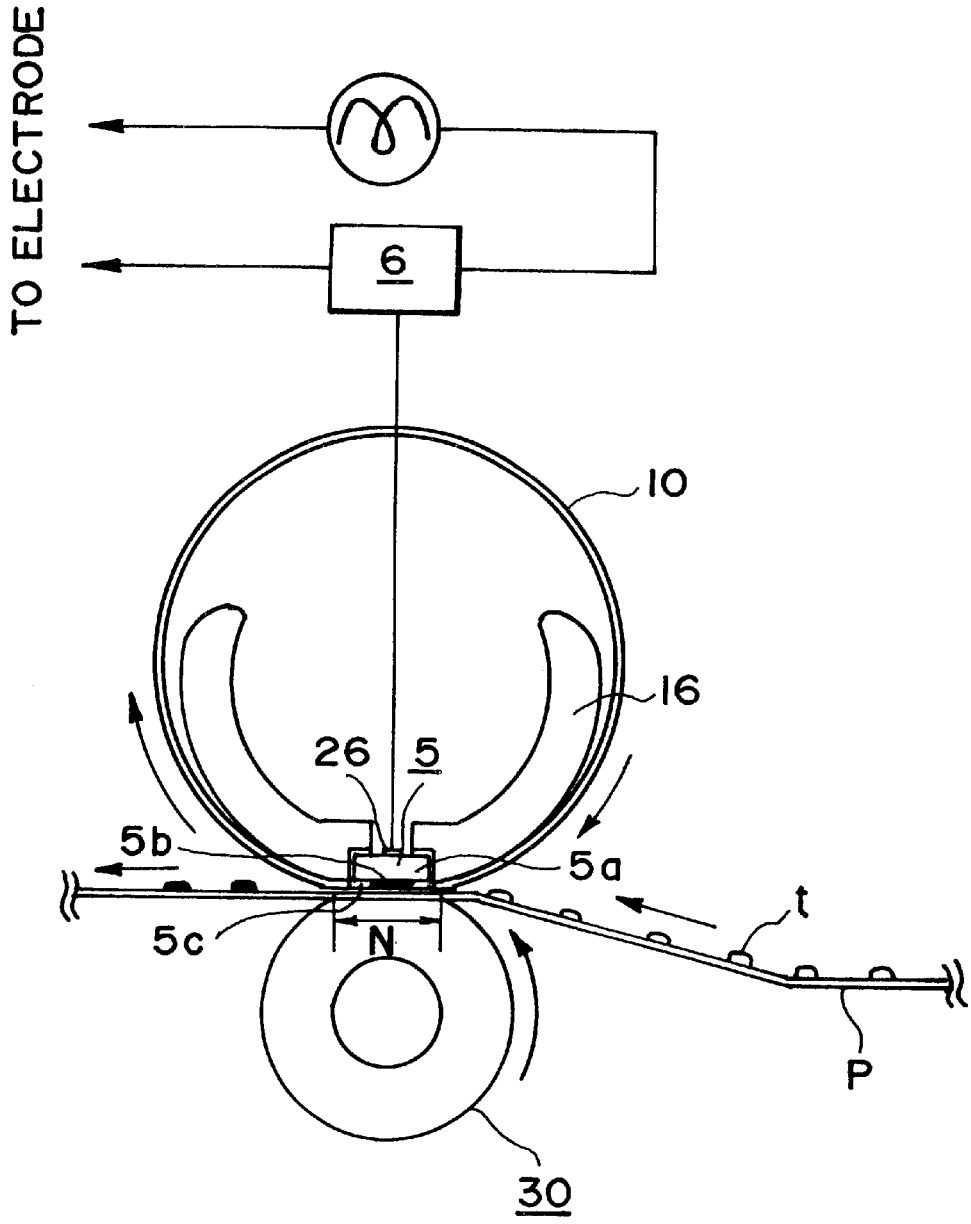
FIG. 15 is a schematic sectional view of an example of a fixing apparatus of a film heating type, which employs a ceramic heater.

Regarding the thermal responsivity of a fixing apparatus, the positional relationship between the heat source and recording medium is compared among a thermal roller type system, a film heating type system employing a ceramic heater, and a film heating type system using electromagnetic induction heat. FIG. 11 shows this positional relationship. FIG. 11, (a) represents a thermal roller type fixing apparatus such as the above described fixing apparatus illustrated in FIG. 14, and FIG. 11, (b) represents a film heating type fixing apparatus such as the above described fixing apparatus illustrated in FIG. 15, which employs a ceramic heater 15. FIG. 11, (c) represents a film heating type fixing apparatus such as the apparatus in this embodiment, which uses electromagnetic induction heat.

(a) In the case of a thermal roller type fixing apparatus, the fixing roller 201, or a heating member, comprises a core shaft 201*b* formed of aluminum or the like, an elastic layer 201*c* formed of silicon rubber or the like, and a mold release layer 201*d* formed of fluorinated resin or the like. In order to increase the strength of the core shaft, the thickness of the core shaft is made to be several millimeters, in many cases. Further, in order to increase the nip width, the thickness of the elastic layer 201*c* is also made to be several millimeters, in many cases. Therefore, the fixing roller 201 is relatively large in thermal capacity and thermal resistance, compared to the other heating means.

Therefore, after the temperature of the fixing roller 201 climbs (descends) to a predetermined level, it does not quickly descends (climbs) even after a heat source 201*a* (halogen lamp) is turned off (on). In addition, the distance from the heat source 201*a* to the peripheral surface of the heating member (fixing roller 201) is relatively long. Therefore, the thermal roller is very poor in terms of the responsiveness to the control temperature change. Thus, if the control temperature is changed, the next print cycle must be delayed until the temperature of the roller surface reaches the control temperature.

(b) In the case of the film heating type fixing apparatus which employs the ceramic heater 5, the fixing film 10 as a heating member comprises an approximately 60 μm thick resin film 301*a* inclusive of an electrically conductive layer, an approximately 300 μm thick silicon rubber layer 301*b* as an elastic layer laid on the resin film 301*a,* and an approximately 30 μm thick fluorinated resin layer 301*c* as a mold release surface layer laid on the silicon rubber layer 301*b.* The purpose for the provision of the silicon rubber layer 301*b* on the resin film 301*a* is to prevent an image from becoming nonuniform in gloss during the fixing operation.

As is evident from the above description, the fixing film 10 is extremely small in thermal capacity in comparison to the fixing roller 201. Also in comparison to the thermal roller 201, the heat source 5 is extremely close to the recording medium P. Therefore, the heating member (fixing film) is excellent in terms of the thermal responsiveness to the change in the control temperature.

However, before the heat from the ceramic heater 5 reaches the toner image t or recording medium P, it must go through the layers 301*a,* 301*b,* and 301*c* of the fixing film, the overall thickness of which is approximately 400 μm. Therefore, it takes some time for the surface temperature of the fixing film to reach the control temperature.

Further, since the heat generating portion is only the nip portion N, the amount of the heat generated in relatively small. Therefore, when the amount of toner per unit area of the recording medium is relatively large as in the case of the full-color image formation, it occurs sometimes that the trailing end of the recording medium is not supplied with a sufficient amount of heat.

(c) In the case of a film heating type fixing apparatus which uses electromagnetically induced heat, the fixing film 10 as a heating member comprises an approximately 50 μm thick electroformed Ni layer 1 as a heat generating layer, an approximately 300 μm thick silicon rubber layer 2 as an elastic layer laid on the Ni layer 1, and an approximately 30 μm thick fluorinated resin layer 3 as a mold release surface layer laid on the silicon rubber layer.

This fixing film 10 also is as small in thermal capacity as the fixing film heated by a ceramic heater 5 in FIG. 11, (b). The heat source in this system is the electroformed Ni layer 1 in which Joule heat is generated by induction current. In terms of the positional relationship between the heat source and recording medium P, this heat source 1 is closest to the recording medium compared to the fixing apparatus represented by FIGS. 11, (a) and (b). In addition, since the electroformed Ni layer itself generates heat by the induction current, the heat generation area is wide. Therefore, compared to the film heating system, depicted by FIG. 11, (b), which employs the ceramic heater 5, this fixing heating type fixing apparatus is superior in thermal repsonsivity, being able to continue to supply a sufficient amount of heat.

As will be evident from the above description, if a fixing apparatus employs a film heating system which uses electromagnetically induced heat, it can instantly respond to the reduction of the control temperature, and therefore, can supply heat by a sufficient amount, that is, an amount neither too much nor too little.

E) Relationship among Recording Medium Conveyance Velocity, Fixation Temperature, and Gloss First, the definition of the word "gloss" used in this embodiment will be described. The value of gloss in this embodiment is based on Method 2 in JIS Z88741, which is used mainly for the measurement of the mirror reflection (gloss).

Figure 12:
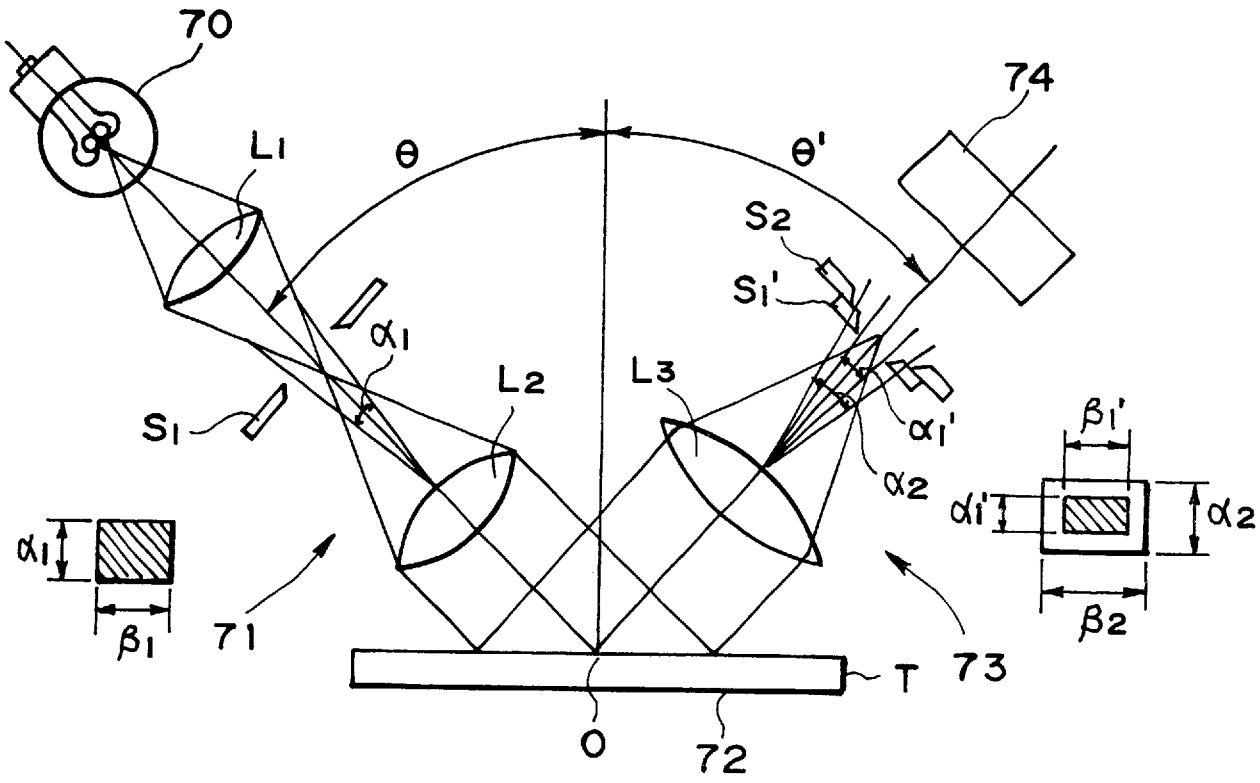
FIG. 12 is a schematic drawing which shows the general structure of a glossmeter.

FIG. 12 is a conceptual drawing of an apparatus for measuring this gloss. Gloss is measured in the following manner. First, light is projected upon a sample 72 from a light source 70 through an optical system 71, and the light reflected by the sample 72 is received by a light receiving device 74 through an optical system 73. Referential codes S1, S1', S2, and S2' represent shifts; $\alpha$1, the opening angle of a light image; $\beta$1, the opening angle in a vertical plane; $\alpha$2, the opening angle of the light receiving device; and referential code $\beta$2 represents the opening angle in a vertical plane.

Gloss G is expressed by the following formula:

$$G=(\phi/\phi s)\times(\text{gloss of the reference surface})$$

$\phi$: flux of light mirror-reflected by the sample 52 with an incidence angle $\theta$ $\phi s$: flux of light reflected by the referential surface.

The value of G (%) is used as the value of the glass in this embodiment.

The gloss measured device used in this embodiment was a product PG-3D (incident angle $\theta$=70 deg.) of Nippon Denshoku Kogyo. As a reference surface, black glass with a gloss of 96.9 (%) was used.

Next, the relationship among the recording medium conveyance velocity, fixation temperature, and gloss, in this image forming apparatus, will be described.

Figure 13:
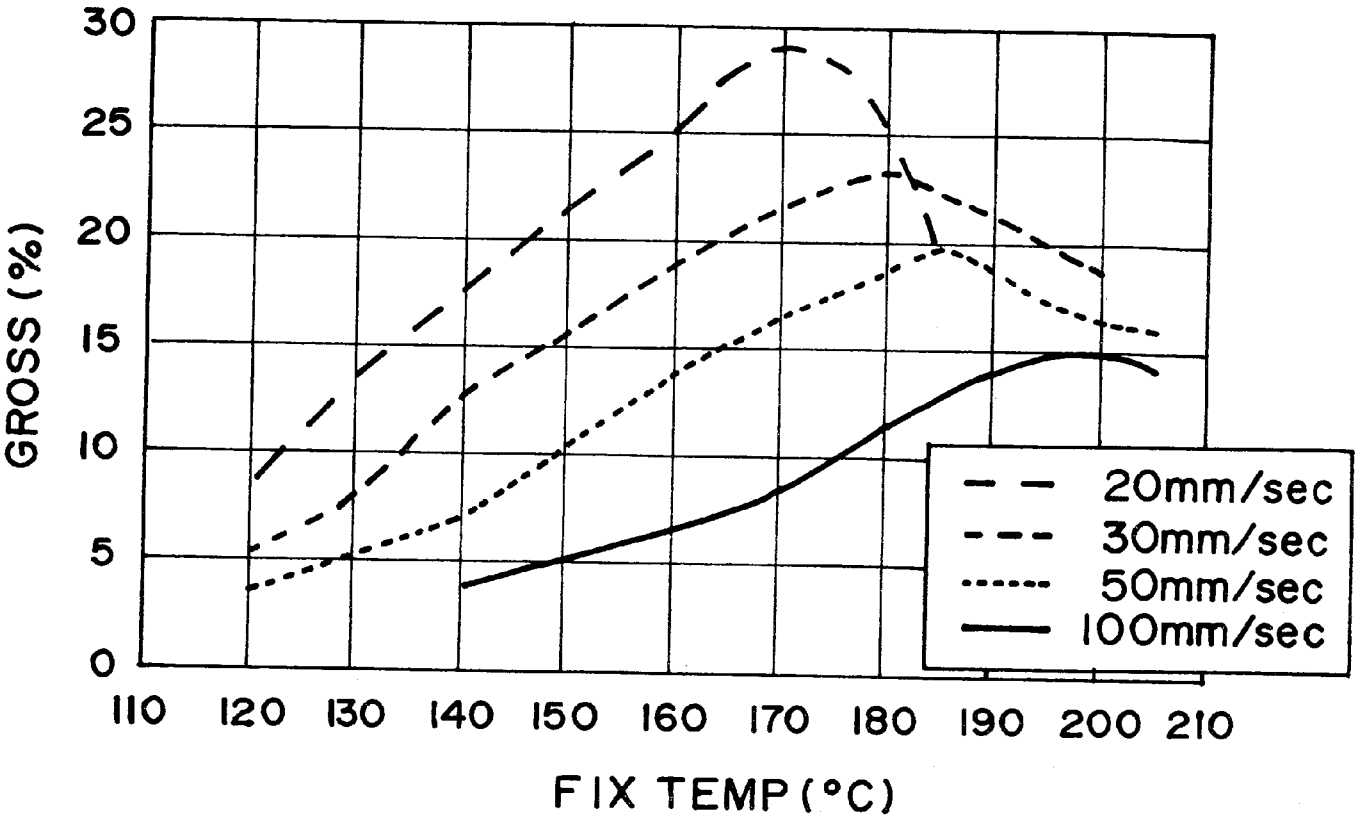
FIG. 13 is a graph which shows the relationship between fixation temperature and gloss.

FIG. 13 is a graph which shows the relationship among the various recording medium conveyance velocities (20 mm/sec, 30 mm/sec, 50 mm/sec and 100 mm/sec), fixation temperature, and gloss, in this apparatus.

The fixation temperature means the surface temperature of the fixing film 10 of the fixing apparatus in this embodiment. The paper used for the tests was of a type with a base weight of 75 g/m$^2$, and the toner had cyan color. The amount of toner per unit area was set at 1.2 mg/cm$^2$, which was equivalent to the amount of toner per unit area of the secondary color portion of an image formed by this image forming apparatus. Hereinafter, the curved line showing the relationship between the fixation temperature and gloss will be referred to as the gloss curve.

Referring to FIG. 13, it is evident that as the fixation temperature is increased, gloss reaches a peak, in the case of each of the aforementioned recording medium conveyance velocities. Up to certain temperature, the higher the temperature, the better a toner image melts, allowing the surface of the toner layer to deform to be flatter; in other words, as the temperature increases, the gloss increases. However, beyond a certain temperature, an excessive amount of heat is supplied, causing the toner to melt excessively, and therefore, giving the surface of the toner layer a hot-offset-like symptom, which causes the toner image surface to roughen; in other words, the gloss declines.

As for the conveyance velocity, the slower it is, the higher the peak value of the gloss curve, and also, the lower the temperature at which the gloss curve reaches its peak. This is done to the fact that the slower the conveyance velocity, the lower the temperature at which a sufficient amount of heat can be supplied, and therefore, the mold release property of the toner image surface layer improves, which results in the improvement of the surface in terms of flatness.

To summarize the above description, in the case of each of the conveyance velocities, there is a temperature at which the gloss becomes maximum; in other words, the temperature at which the gloss becomes maximum varies according to the conveyance velocity. Thus, when selecting a specific fixing mode to yield a high gloss image, the control temperature must be changed according to the conveyance velocity. The control temperature is desired to be set at a temperature close to the peak of the gloss curve for the selected conveyance velocity. If the temperature exceeds this temperature, not only does the gloss decline, but also he toner image surface becomes nonuniform in gloss due to the hot offset. As a result, image quality declines.

In this embodiment, as a sequence for accomplishing high gloss, a fixing sequence in which not only the conveyance velocity was lower than the normal conveyance velocity, but also the control temperature was lower, was provided.

The fixation process desired by a user is selected according to the signal from a computer or the like connected to an image forming apparatus. When a high gloss image is desired, the fixation condition is switched to the high gloss condition by the CPU (unillustrated) on the image forming apparatus main assembly side.

Next, the effects of this embodiment will be described. In this embodiment, in order to verify the effects of the present invention, the control temperature was varied to compare the images yielded at different temperature, while using a recording medium conveyance velocity slower than the normal velocity. The contents and results of this verification will be described hereinafter.

In this embodiment, conveyance velocities of 30 mm/sec and 20 mm/sec were selected as the conveyance velocity at which a sufficient amount of heat could be supplied. The control temperature was varied with an increment of 5° C. For the recording medium, paper with a base weight of 75 g/cm$^2$ was used. The amount of toner per unit area of paper was set at 1.2 mg/cm$^2$, which is equivalent to the amount of toner for the secondary color portion of an image formed by the image forming apparatus in this embodiment.

Table 1 shows the results of the above described verification.

TABLE 1

Fixation Conditions and Image Gloss on Paper

| | Conveyance velocity | Control temp. | Gloss (%) |
|---|---|---|---|
| Normal (reference) | 100 mm/sec | 190° C. | 14 |
| Comp. Example 1 | 30 mm/sec | 190° C. | 18 (+14) |
| Embodiment 1 | ditto | 180° C. (−10 deg.) | 23 (+19) |
| Comp. Example 2-1 | 20 mm/sec | 190° C. | [Hot offset] |
| Comp. Example 2-2 | ditto | 180° C. (−10 deg.) | 26 (+12) |
| Embodiment 2 | ditto | 170° C. (−20 deg.) | 29 (+15) |

( ) shows deviation from normal

The normal conveyance velocity in the image forming apparatus in this embodiment was 100 mm/sec, and the normal control temperature was 190° C. With this setup (normal setup), the gloss was 14%.

Next, when the conveyance velocity was decreased to 30 mm/sec, if the control temperature was kept at 190° C. (Comparative Example 1), the gloss was 18%. This value is 4% higher than the normal gloss value, but the image displayed a slight sign of hot offset.

Conventionally, the gloss could be increased to 23% by decreasing the control temperature by 10 degrees to 180° C. (Embodiment 1). This gloss value was higher than the normal gloss value by 9%, providing a high quality image with a high degree of gloss. However, decreasing the control temperature further resulted in the reduced gloss, proving that in the case of the conveyance velocity of 30 mm/sec, a temperature of 180° C., which was 10% lower than the normal control temperature value, was the optical control temperature.

Next, when the conveyance velocity was lowered to 20 mm/sec, if the control temperature was kept at 190° C. (Comparative Example 2-1), an oversupply of heat caused hot offset, preventing the gloss from being measured. However, as the control temperature was reduced by 10° C. to 180° C. (Comparative Example 2—2). the gloss was improved to 26%. This value was higher the normal value by 12%, but the image showed a slight sign of hot offset.

As the control temperature was reduced by 20° C. to 170° C. (Embodiment 2), the gloss increased to 29%. This value is higher by approximately 15% compared to the value with the normal conveyance velocity, providing a high quality image with high gloss. As the control temperature was further decreased, the gloss reduced, providing that the temperature of 170° C. which was 20° C. lower than the normal value was the optimum control temperature.

As described above, when a fixing apparatus which uses electromagnetically induced heat is employed, the gloss of an image on recording medium can be improved without causing fixture failure, by reducing the recording medium conveyance velocity as well as the control temperature.

<Embodiment 2>

Next, the image forming apparatus in the second embodiment of the present invention will be described. The image forming apparatus in this embodiment is the same as the image forming apparatus in the first embodiment illustrated in FIG. 1, and further, the fixing apparatus in this embodiment is the same as the fixing apparatus in the first embodiment illustrated in FIGS. 2–10, and therefore, their descriptions will be omitted.

In this embodiment, a case in which the recording medium conveyance velocity is rendered lower than the normal velocity, and the control temperature is increased, will be described. This case relates to when a sheet of recording medium, for which the normal conveyance velocity is improper for fixation, is fed. As such recording medium, there are cardboard with a large base weight (for example, a base weight of 150 g/m$^2$ or more), or medium with a large thermal capacity such as OHP film or gloss film, for example. In particular, in the case of OHP film or gloss film, it is required that not only the toner adhesion to the film is excellent, but also the fixed toner image is high in transparency as well as gloss. In other words, it is required that the toner image surface is flat after its fixation. In order to meet such requirements, that is, in order to improve toner images on the aforementioned media in terms of the post-fixation transparency and gloss, a large amount of heat is necessary during the fixation process.

With the fixing apparatus in accordance with the present invention, the increase in the control temperature can be instantly dealt with to supply heat by a sufficient amount, that is, an amount neither more nor less than necessary, for fixation.

In this embodiment, as a fixation sequence for OHP film, a fixation sequence in which the conveyance velocity is lower than the normal one, and the control temperature is higher, is provided. The type of recording medium is identified based on the signal from a computer connected to an image forming apparatus, or an OHP film sensor with which an image forming apparatus is provided, and when the recording medium is OHP film, the operational sequence of the apparatus is switched to the fixing sequence which satisfies the fixation condition for OHP film by a CPU (unillustrated) provided on the image forming apparatus main assembly side.

In order to verify the effects of the present invention, the toner images on OHP film are comparatively evaluated, while varying the conveyance velocity and control temperature. The contents and results of this verification will be described below.

In this embodiment, as the conveyance velocities at which heat can be supplied by the amount sufficient for OHP film, conveyance velocities of 50 mm/sec, 40 mm/sec, and 30 mm/sec, which were slower than the normal conveyance velocity, were selected. The control temperature was varied with an increment of 5° C., and the toner image on OHP film were compared in terms of transparency, under the above conditions.

As reference images for evaluating the toner images on OHP film, sheets of OHP film covered with primary color (yellow, magenta, and cyan) patches, and secondary color (red, green, and blue) patches, the density of which ranged in gradient from 10% to 100%, with an increment of 10%, were prepared. As for the evaluation method, the images on the OHP film were projected with the use of an overhead projector, in a dark room, and the images thus obtained were compared. The worse the transparency, the smaller the amount of light transmitted, causing the projected image to appear darker; in other words, color cannot be truly reproduced. The projected images were visually compared for relative evaluation, in terms of transparency level. The results of this verification are given in Table 2.

TABLE 2

Fixation Conditions and Transparency of Image on OHP Film

| | Conveyance velocity | Control temp. | Transparency |
|---|---|---|---|
| Normal (reference) | 100 mm/sec | 190° C. | (Fixation impossible) |
| Comp. Example 1 | 50 mm/sec | 190° C. | x |
| Embodiment 1 | ditto | 205° C. (+15 deg.) | o |
| Comp. Example 2 | 40 mm/sec | 190° C. | F |
| Embodiment 2 | ditto | 200° C. (+10 deg.) | o |
| Comp. Example 3 | 30 mm/sec | 190° C. | o |
| Embodiment 3 | ditto | 195° C. (+5 deg.) | oo |

( ) shows deviation from normal
oo: Very good
o: Good
F: No practical problem
x: Not practical When the image forming apparatus in this embodiment was set at the maximum conveyance velocity of 100 mm/sec, and at the control temperature of 190° C. (normal), a sufficient amount of heat could not be supplied, and therefore, the toner images on OHP sheets could not be fixed; fixation failure occurred.

Next, when the conveyance velocity was lowered to 50 mm/sec while keeping the control temperature at 190° C. (Comparative Example 1), fixation was possible but the images on OHP sheets were inferior in transparency, being below the level of practical use, in particular, across the secondary color portions where the amount of the toner per unit area was greater.

Next, as the control temperature was increased by 15° C. from 190° C. to 205° C. (Embodiment 1), the transparency was improved to a preferable level. Further increase in the control temperature caused the toner layer surface to display a slight sign of hot offset, rendering the surface rough, which results in the reduction of transparency. Therefore, it was not desirable.

Next, when the conveyance velocity was further reduced to 40 mm/sec while keeping the control temperature at 190° C. (Comparative Example 2), the transparency reached at least to a level at which there was no practical problem, solely due to the conveyance velocity slower than 50 mm/sec (Comparative Example 1).

Next, when the control temperature was raised by 10° C. from 190° C. to 200° C. (Embodiment 2), the transparency improved to a preferable level, which was the same level as the level in the Embodiment 1. In other words, the control temperature could be low by virtue of the low fixing velocity. Further increase of the control temperature caused the surface to become rough, reducing the transparency instead of increasing it, and therefore, it was not desirable.

Next, when the conveyance velocity was further reduced to 30 mm/sec while maintaining the control temperature at 190° C. (Comparative Example 3), the transparency reached a preferably level only because the conveyance velocity was slower than 50 mm/sec (Comparative Example 1).

As the control temperature was increased by 5° C. from 190° C. to 195° C. (Embodiment 3), the transparency became extremely good: the transparency could be further improved. Further increase in the control temperature caused the surface to become rough, reducing the transparency instead of increasing it: it is not desirable.

As described above, the transparency of a toner image on OHP film can be further improved by increasing the control temperature while reducing the conveyance velocity, with the use of a fixing apparatus which employs an electromagnetic induction heating system.

<Miscellaneous Embodiments>

1) The present invention is applicable also to a case in which a multiple step temperature control, which changes in steps the control temperature according to the number of prints, is used. When applying the present invention to such a case, the control temperature may be increased or decreased in steps, uniformly or in proportion to the number of prints.

2) The film heating type fixing apparatus based on electromagnetic induction, in each of the above described embodiments, may be differently structured. For example, it may comprise an endless belt of electromagnetic induction based heat generating film 10, as a heating member, which is stretched around, and suspended by, a plurality of members, and is rotationally driven by a driving means, or may comprise a long roll of electromagnetic induction based heat generating film 10, which is drawn out as it is used.

3) The electromagnetic induction based heat generating film 10 used for thermally fixing monochromatic images or single-pass multi-color images may lack the elastic layer 2. The electromagnetic induction based heat generating layer 1 may be formed by mixing metallic filler into resinous material. The electromagnetic induction based fixing film 10 may be a single layer of electromagnetic induction based heat heating material.

4) The pressure applying member 30 does not need to be in the form a roller; it may be in a different form, for example, a rotational belt.

A heating means such as an electromagnetic induction based heating member may be provided on the pressure applying member 30 side, so that the temperature of the fixing nip is increased to, and maintained at, a predetermined level, and the recording medium is supplied with thermal energy, not only from the fixing film 10 side, but also from the pressure application member 30 side.

5) The application of the image heating apparatus in accordance of the present invention is not limited to the image forming apparatuses in the above embodiments; it is usable as an image heating apparatus for improving the surface property such as gloss by heating the recording medium on which an image is borne, an image heating apparatus for temporary fixation, or the like.

As described above, according to the present invention, it is possible to provide an image heating apparatus capable of instantly changing the amount of the heat to be supplied to the recording medium on which an image to be thermally treated is borne, so that the image and recording medium is provided with heat by an amount neither more nor less than necessary, to change the gloss of the image, or to improve the transparency of the image on OHP film, and also it is possible to provide an image forming apparatus comprising such an image heating apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus for heating an image formed on a recording material, comprising:

a rotatable fixing film having at least a heat generating layer and an elastic layer;

an excitation coil for generating a magnetic field to induce an eddy current in said heat generating layer;

a pressure roller contacted to said fixing film, wherein the recording material is heated while being passed between said film and said pressing roller;

a temperature detecting element for detecting a temperature of said rotatable fixing film;

control means for controlling an electric supply to said excitation coil so that the temperature detected by said temperature detecting element is maintained at a target temperature; and heating condition setting means for setting a feeding speed of the recording material and the target temperature, wherein said apparatus is operable in a normal mode and a high glossiness mode, and wherein in the high glossiness mode, said control means sets the feeding speed of the recording material and the target temperature at respective levels which are higher than those in the normal mode, and wherein if a plurality of recording materials are continuously heated in the high glossiness mode, the target temperature is gradually decreased in accordance with the number of the recording materials.

2. An image heating apparatus according to claim 1, wherein said heating condition setting means sets the feeding speed of the recording material and the target temperature in accordance with a kind of the recording material.

3. An image heating apparatus according to claim 1, wherein said heating condition setting means sets the feeding speed of the recording material and the target temperature in accordance with a glossiness selected by a user.

4. An image heating apparatus according to claim 1, wherein said control means controls the electric supply to said excitation coil in accordance with a deviation between the detected temperature detected by said temperature detecting element and the target temperature.

5. An image heating apparatus according to claim 4, wherein said control means controls a frequency of the electric supply in accordance with the deviation.

6. An image heating apparatus according to claim 1, wherein said heating member is movable while being in contact with the recording material.

* * * * *

UNITED STATES PATENT AND TRADEMARK OFFICE

CERTIFICATE OF CORRECTION

PATENT NO. : 6,674,978 B1
DATED : January 6, 2004
INVENTOR(S) : Masahiro Suzuki et al.

It is certified that error appears in the above-identified patent and that said Letters Patent is hereby corrected as shown below:

Column 1,
Line 20, “devices” should read -- device --; and “an” should read -- and --.

Column 2,
Line 51, “rise” should read -- raise --.

Column 3,
Line 21, “PSEK,” should read -- PEEK --.

Column 4,
Line 38, “ORFfilm” should read -- OHPfilm --.

Column 5,
Line 13, “temperature detected by said” should be deleted.

Column 9,
Line 51, “insulting” should read -- insulating --.
Line 63, “cure” should read -- core --.
Line 65, “fluorinated rubbers” should read -- fluorinated rubber, --.

Column 10,
Line 10, “racing” should read -- facing --.
Line 65, “wakeup” should read -- makeup --.

Column 11,
Line 4, “film” should read -- film 10, --.
Line 5, “between” should read --and between --; “logs)” should read -- loss) --.
Line 6, “to the “ should read -- due to the --.
Line 7, “bear” should read -- heat --.
Line 14, “angle 9” should read -- angle θ --.
Line 52, “he fixing” should read -- the fixing --.

UNITED STATES PATENT AND TRADEMARK OFFICE

CERTIFICATE OF CORRECTION

PATENT NO. : 6,674,978 B1
DATED : January 6, 2004
INVENTOR(S) : Masahiro Suzuki et al.

It is certified that error appears in the above-identified patent and that said Letters Patent is hereby corrected as shown below:

Column 12,
Line 20, “at position” should read -- at a position --.
Line 21, “region” should read -- region H --.
Line 29, “us”should read -- as --.
Line 40, “net” should read -- not --; “b use no at” should read -- because no heat --.
Line 50, “clement” should read -- element --.

Column 13,
Line 5, “used” should read --is used --.
Line 15, “materiel” should read -- material --; and “16aand” should read -- 16a and --.
Line 16, “exciting” should read -- (exciting --.
Line 21, “PPA resin,” should read -- PFA resin, --; and “LCF resin,” should read -- LCP resin, --.
Line 22, “cares” should read -- cores --.
Line 29, “bare” should read -- here -- ; and “neat” should read -- heat --.
Line 31, “long as” should read -- as long as --.
Line 43, “capabble” should read -- capable --.
Line 59, “on heating” should read -- a heating --.

Column 14,
Line 34, “of the like,” should read -- or the like, --.

Column 15,
Line 14, “beat” should read -- heat --.
Line 16, “fluoro-silicone rubber” should read -- fluoro –silicone rubber, --.
Line 36, “polyamideimide” should read -- polyamide-imide --.
Line 43, “band,” should read --hand, --.
Line 47, “beat” should read --heat --,
Line 54, “neat” should read -- heat --.
Line 55, “medium F,” should read -- medium P, --.

Column 16,
Line 18, “currant” should read -- current --.
Line 21, “ment” should read -- ment; --.
Line 39, “a PET” should read -- an FET --.
Line 49, “performs” should read -- performs --.

UNITED STATES PATENT AND TRADEMARK OFFICE

CERTIFICATE OF CORRECTION

PATENT NO. : 6,674,978 B1
DATED : January 6, 2004
INVENTOR(S) : Masahiro Suzuki et al.

It is certified that error appears in the above-identified patent and that said Letters Patent is hereby corrected as shown below:

Column 17,
Line 18, “aids” should read -- side --.
Line 60, “and” should read -- end --.

Column 18,
Line 1, “currant” should read -- current --.

Column 22,
Line 14, “also he” should read -- also the --.

Column 23,
Line 28, “providing” should read -- provided --.

Signed and Sealed this

First Day of June, 2004

JON W. DUDAS
*Acting Director of the United States Patent and Trademark Office*